US005939824A

United States Patent [19]

Kishi et al.

[11] Patent Number: 5,939,824

[45] Date of Patent: Aug. 17, 1999

[54] ELECTRON EMITTING DEVICE HAVING A CONDUCTIVE THIN FILM FORMED OF AT LEAST TWO METAL ELEMENTS OF DIFFERENCE IONIC CHARACTERISTICS

[75] Inventors: Fumio Kishi, Kanagawa-ken; Yoshiyuki Osada, Atsugi; Hisaaki Kawade, Yokohama; Takeo Tsukamoto, Atsugi; Shigeki Yoshida, Isehara; Takao Kusaka, Yokohama, all of Japan

[73] Assignee: Canon Kabushiki Kaisha, Tokyo, Japan

[21] Appl. No.: 08/654,262

[22] Filed: May 28, 1996

[30] Foreign Application Priority Data

May 30, 1995 [JP] Japan ..... 7-154068
Dec. 28, 1995 [JP] Japan ..... 7-342707

[51] Int. Cl.[6] ..... H01J 1/62; H01J 9/02

[52] U.S. Cl. ..... 313/495; 313/346 R; 313/311

[58] Field of Search ..... 313/495, 309, 313/310, 336, 351, 355, 346 R, 346 DC, 512, 311

[56] References Cited

U.S. PATENT DOCUMENTS

| | | | |
|---|---|---|---|
| 4,810,934 | 3/1989 | Simoda et al. | 315/107 |
| 5,066,883 | 11/1991 | Yoshioka et al. | 313/309 |
| 5,285,079 | 2/1994 | Tsukamoto et al. | 257/10 |

FOREIGN PATENT DOCUMENTS

| | | |
|---|---|---|
| 0251328 | 7/1987 | European Pat. Off. . |
| 0299461 | 7/1988 | European Pat. Off. . |
| 1031332 | 2/1989 | Japan . |
| 1283749 | 11/1989 | Japan . |
| 2257552 | 10/1990 | Japan . |
| 7235255 | 9/1995 | Japan . |

OTHER PUBLICATIONS

W. P. Dyke, et al, "Field Emission —Introduction", Advances in Electronics and Electron Physics, Academic Press Inc., Publ., NY, vol. III 1956, pp. 90–184.

C. A. Mead, "Operation of Tunnel–Emission Devices", Journal of Applied Physics, vol. 32, No. 4, Apr. 1961, pp. 646–652.

M. I. Elinson, et al, "The Emission of Hot Electrons and The Field Emission of Electrons From Tin Oxide", Radio Engineering and Electronic Physics, No. 7, Jul. 1965, pp. 1290–1296.

G. Dittmer, "Electrical Conduction and Electron Emission of Discontinuous Thin Films", Thin Solid Films—Elsevier Sequoia S.A., Lausanne, Switzerland, Jul. 4, 1971, pp. 317–329.

M. Hartwell, et al., "Strong Electron Emission From Patterned Tin–Indium Oxide Thin Films", International Electron Devices Meeting, Washington, D.C., 1975, pp .519–521.

C. A. Spindt, et al., "Physical Properties of Thin–Film Field Emission Cathodes with Molybdenum Cones", Journal of Applied Physics, 1976, vol. 47, No. 12, Dec. 1976, pp. 5248–5263.

*Primary Examiner*—Jay M. Patidar
*Attorney, Agent, or Firm*—Fitzpatrick, Cella, Harper & Scinto

[57] ABSTRACT

An electron emitting device includes a pair of device electrodes disposed at locations opposite to each other, a conductive thin film in contact with both the pair of device electrodes, and an electron emitting region formed in a part of the conductive thin film. The conductive thin film is composed of fine particles including a first metal element serving as a main constituent element and at least one second metal element. The second metal element is to precipitate at the surface of the conductive thin film and thus form a low work function material layer. When a voltage is applied between the pair of device electrodes, the second metal element moves from the inside of the conductive thin film to at least a part of the surface of the conductive thin film.

5 Claims, 17 Drawing Sheets

FIG. 1A
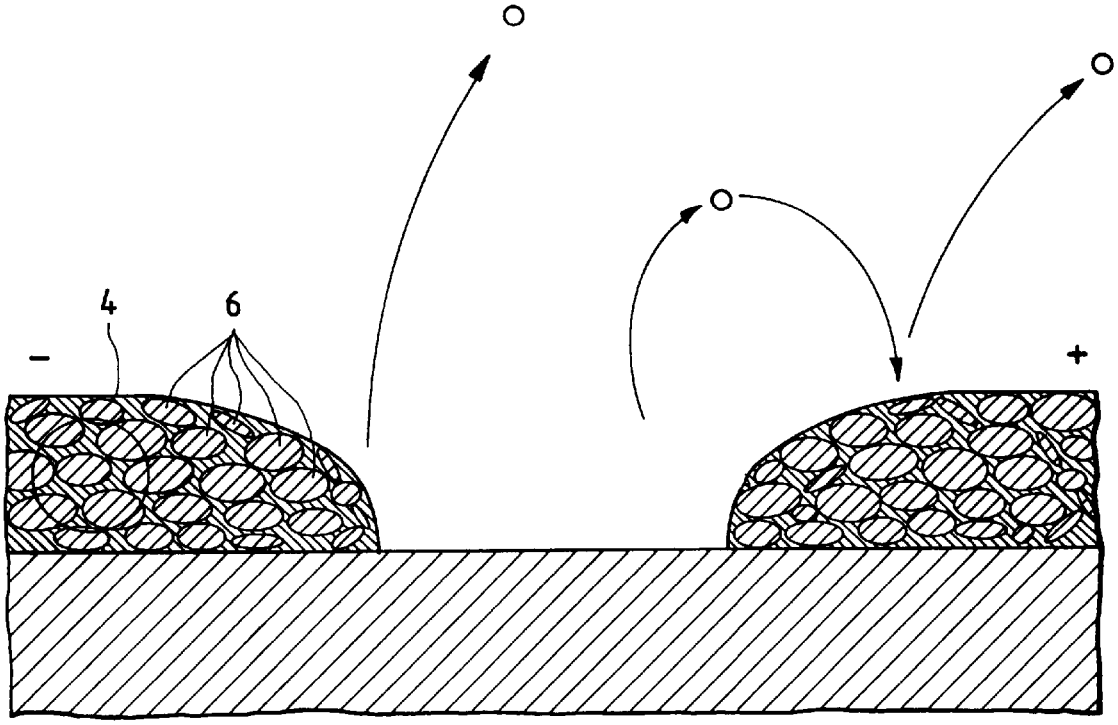
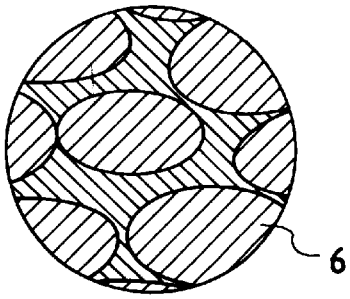
FIG. 1B

ELECTRON EMITTING DEVICE HAVING A CONDUCTIVE THIN FILM FORMED OF AT LEAST TWO METAL ELEMENTS OF DIFFERENCE IONIC CHARACTERISTICS

BACKGROUND OF THE INVENTION

1. Field of the Invention

The present invention relates to a surface conduction electron emitting device, an electron source provided with a surface conduction electron emitting device, and an image forming apparatus provided with an electron source. The present invention also relates to a method of producing such devices.

2. Related Background Art

Electron emitting devices are roughly classified into two types: a thermionic emission type and a cold-cathode emission type. Electron emitting devices of the cold-cathode emission type are further classified into several types. They include a field emission type (hereafter referred to as an FE type), a metal/insulator/metal type (hereafter referred to as an MIM type), and a surface conduction electron-emitting type. Examples of FE types are disclosed for example in "Field Emission" (W. P. Dyke and W. W. Dolan, Advance in Electron Physics, 8, 89 (1956)) and "Physical Properties of Thin-Film Field Emission Cathodes with Molybdenum Cones" (C. A. Spindt, J. Appl. Phys., 47, 5248 (1976)).

An example of an MIM type has been reported by C. A. Mead in his paper entitled "Operation of Tunnel-Emission Devices", J. Apply. Phys., 32, 646 (1961).

An example of a surface conduction electron emitting device has been reported by M. I. Elinson (Radio Eng. Electron Phys., 10, 1290 (1965)).

Surface conduction electron emitting devices use a phenomenon that electron emission occurs when a current is passed through a thin film with a small area formed on a substrate so that the current flows in a direction parallel to the film surface. Various types of surface conduction electron emitting devices are known. They include a device using a thin $SnO_2$ film proposed by Elinson et al. as aforementioned, a device using a thin Au film (G. Dittmer, Thin Solid Films, 9, 317 (1972)), a device using a thin $In_2O_3/SnO_2$ film (M. Hartwell and C. G. Fonstad, IEEE Trans. ED Conf., 519 (1975)), and a device using a thin carbon film (Araki et al., Vacuum, 26 (1), 22 (1983)).

A typical surface conduction electron emitting device is schematically shown in FIGS. 2A and 2B wherein FIG. 2A is a plan view and FIG. 2B is a cross-sectional view. As shown in FIGS. 2A and 2B, the device includes a substrate 1, device electrodes 2 and 3, a conductive thin film 4, and an electron emitting region 5. The electron emitting region 5 is formed by conducting a current through the conductive thin film 4 after forming the device electrodes 2 and 3 and the conductive thin film 4 on the substrate 1. This process is known as an energization forming process. In the energization forming process, a voltage is applied between the device electrodes 2 and 3 so that a current flows through the conductive thin film thereby introducing local breakage, deformation, or qualitative change in the conductive thin film and thus forming an electron emitting region 5 having a high electric resistance. In the electron emitting region 5, a fissure or fissures are formed in a part of the conductive thin film and electrons are emitted from the fissure(s) or regions near the fissure(s) when a voltage is applied between the device electrodes so that a current is passed through the conductive thin film.

The methods of forming the device electrodes and the conductive thin film, the energization forming process of forming the electron emitting region, and other processes are disclosed for example in Japanese Patent Application Laid-Open No. 7-235255.

The electron emitting device of the surface conduction type has a simple structure and thus can be easily produced. Therefore, it is possible to dispose a great number of similar devices over a large area. Because of these advantages, a lot of research and development activities are being made to apply the surface conduction electron emitting device to various apparatuses and systems such as a charged-beam source, an image display device, etc. For example, an electron source having a large number of surface conduction electron emitting devices has been reported in which a plurality of electron emitting devices are disposed along a line called a device row and a plurality of similar device rows are disposed wherein in each device row, one electrode of each electron emitting device is connected in common to an interconnection, while the other electrode of each electron emitting device is connected in common to another interconnection (for example refer to Japanese Patent Application Laid-Open No. 64-031332, Japanese Patent Application Laid-Open No. 1-283749, Japanese Patent Application Laid-Open No. 2-257552).

In recent years, a flat panel type image forming apparatus using a liquid crystal (LCD) has come to be widely used as an image display device instead of a cathode-ray tube (CRT). However, LCDs are not a device of the emission type and thus have the disadvantage that a back light is required. Thus, there is a need for a display device of the emission type. One known technique to realize a display device of the emission type is to employ an electron source provided with an array of a great number of surface conduction electron emitting devices to excite a fluorescent screen thereby emitting visible light. This technique is disclosed for example in U.S. Pat. No. 5,066,883.

When an electron emitting device is used in practical applications, it is required that good electron emission characteristics be maintained for a long time without instability.

In surface conduction electron emitting devices, two important characteristics are the magnitude of electron emission current (denoted by Ie) and the electron emission efficiency ($\eta$).

The electron emission efficiency refers to the ratio of the emission current Ie to the current (device current If) flowing between the device electrodes, that is, $\eta = Ie/If$.

To use a surface conduction electron emitting device in a practical application, it is required that the magnitude of the emission current and the electron emission efficiency be maintained at constant values for a long time without instability. Besides, it is desirable that the device can provide a large emission current and a high electron emission efficiency.

For example, when a surface conduction electron emitting device is employed in an image forming apparatus, the emission current Ie should be great enough to achieve a sufficiently bright image. If the electron emission efficiency $\eta$ is high enough, then it is possible to achieve a bright image with low electric power consumption. This results in a reduction in the load of a driving circuit, which allows a reduction in the total cost.

The above requirements are not met satisfactorily in the conventional surface conduction electron emitting devices, and it is still required to increase the emission current Ie and the electron emission efficiency η and it is also required to improve the stability of the electron emission characteristics.

SUMMARY OF THE INVENTION

It is an object of the present invention to solve the above problems. More specifically, it is an object of the present invention to provide a surface conduction electron emitting device having improved stability in the electron emission characteristics. It is a still another object of the present invention to provide a surface conduction electron emitting device having a high emission current Ie and a high electron emission efficiency η.

The above objects are achieved by the present invention having various aspects as described below.

According to an aspect of the invention there is provided an electron emitting device including a pair of device electrodes disposed at locations opposite to each other, a conductive thin film in contact with both device electrodes, and an electron emitting region formed in a part of the conductive thin film, the electron emitting device being characterized in that: the conductive thin film is composed of fine particles including a first metal element serving as a main constituent element and (a) second metal element(s) which precipitate(s) at the surface of the conductive thin film and thus forms a low work function material layer; and when a voltage is applied between said pair of device electrodes, the second metal element(s) move(s) from the inside of the conductive thin film to at least a part of the surface of the conductive thin film.

According to another aspect of the invention, the above-described conductive thin film is composed of fine particles of an alloy including the first metal element and the second metal element(s).

According to still another aspect of the invention, the above-described conductive thin film includes fine particles substantially consisting of the first metal element and fine particles substantially consisting of the second metal element(s).

According to a further aspect of the invention, the ionic radius of the most stable ion of the first metal element is greater than the ionic radius (radii) of the most stable ion(s) of the second metal element(s).

Hereinafter, though the second metal element is represented as a singular form, plural metal elements may be employed for the purpose of the present invention.

According to another aspect of the invention, the above-described conductive thin film is composed of fine particles having a structure including a phase of the first metal element, wherein the phase further includes a phase of an intermetallic compound consisting of said first metallic element and the second metal element.

According to still another aspect of the invention, the above-described first metal element is a noble metal element and the above-described second metal element is an alkali metal element or an alkaline-earth metal element.

According to another aspect of the invention, the above-described conductive thin film is substantially composed of a noble metal element and an alkali metal element or an alkaline-earth metal element such that the conductive thin film has an average composition with a content of the alkali metal element or the alkaline-earth metal element in the range from 3 atomic % to 8 atomic %.

According to a further aspect of the invention, there is provided an electron source including: one or more device rows, each device row including a plurality of electron emitting devices described above; and interconnections for driving the electron emitting devices.

According to still another aspect of the invention, there is provided an electron source in which the above-described interconnection is of a ladder type interconnection.

According to a further aspect of the invention, there is provided an electron source in which the above-described interconnection is disposed in a matrix form.

According to another aspect of the invention, there is provided an image forming apparatus comprising: a vacuum container; an electron source described above; and an image forming member which emits light in response to irradiation of an electron beam emitted by the electron source onto a desired pixel thereby forming an image; wherein the electron source and the image forming member are accommodated in the vacuum case.

According to a further aspect of the invention, there is provided an image forming apparatus comprising: a vacuum case; an electron source described above; an image forming member which emits light in response to irradiation of an electron beam emitted by the electron source onto a desired pixel thereby forming an image; and electron beam modulation means for modulating the electron beam irradiating the image forming member in response to an input signal; wherein the electron source, the image forming member, and the electron beam modulation means are accommodated in the vacuum case.

According to another aspect of the invention, there is provided an image forming apparatus in which the above-described interconnection is of a ladder type interconnection.

According to still another aspect of the invention, there is provided an image forming apparatus in which the above-described interconnection is disposed in a matrix form.

According to a further aspect of the invention, there is provided an image forming apparatus in which the above-described image forming member is a fluorescent film including a phosphor.

According to a further aspect of the invention, there is provided a method of recovering the characteristics of an electron emitting device, an electron source, and an image forming apparatus, the method comprising the step of applying a voltage to the electron emitting device in such a manner that the voltage is selected to a value in the range greater than the threshold voltage of the electron emitting device with respect to the device current and lower than the apply voltage employed in a normal electron emission operation.

BRIEF DESCRIPTION OF THE DRAWINGS

FIGS. 1A and 1B are schematic diagrams illustrating the structure of an electron emitting region and its vicinity of a surface conduction electron emitting device according to a first embodiment of the invention;

FIGS. 2A and 2B are schematic diagrams generally illustrating the structure of a surface conduction electron emitting device employed in conventional techniques and also in the present invention, wherein FIG. 2A is a plan view and FIG. 2B is a cross-sectional view;

DESCRIPTION OF THE PREFERRED EMBODIMENTS

Figure 2A:
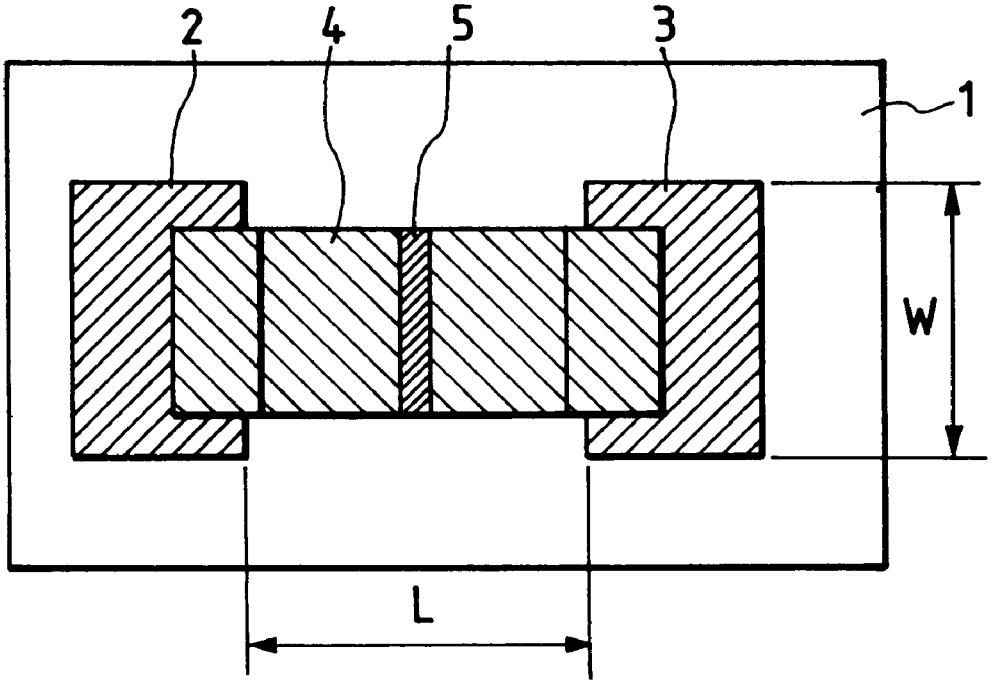
FIG. 2A PRIOR ART

The surface conduction electron emitting device of the invention is described below in detail. The conductive thin film having an electron emitting region formed in a part thereof includes at least a metal element serving as a main constituent metal element and a metal element to constitute a low work function material wherein the metal element to constitute the low work function material diffuses toward the electron emitting region due to the energy given when a current is conducted through the device.

In a first embodiment of the invention, the conductive thin film is a fine particle film consisting of fine particles of an alloy including a main constituent metal element and a metal element to constitute a low work function material.

In a second embodiment of the invention, the conductive thin film is a mixed fine particle film including fine particles substantially consisting of the main constituent metal element and fine particles substantially consisting of the metal element to constitute the low work function material.

In a modified mode of the first or second embodiment of the invention, the ionic radius of ion having the most stable ionic charge number of the metal element to constitute the low work function material is smaller than the ionic radius of ion having the most stable ionic charge number of the main constituent metal element.

In a third embodiment of the invention, the above-described conductive thin film is composed of fine particles having a structure in which a phase of an intermetallic compound of the main constituent metallic element and the metal element to constitute the low work function material is included in a phase of the main constituent metal element.

In a modified mode of the third embodiment of the invention, the above-described metal element to constitute the low work function material is an alkali metal element or an alkaline-earth metal element, and the above-described main constituent metal element is a noble metal element.

In this description, the term "particle" is used very frequently, and thus the term should be defined here.

Particles having a small size are called "fine particles", and particles having a further smaller size are called "ultrafine particles". Particles smaller than "ultrafine particles", composed of a few hundred or less atoms, are called "cluster". Although these terminologies are common in the art, the boundaries among these are not very strict, and depend on the characteristic of interest. Furthermore, the term "fine particle" is often used to represent both the "fine particle" and the "ultrafine particle", and thus the term "fine particle" is used here in the present description to represent both the "fine particle" and the "ultrafine particle".

In "Experimental Physics 14: Surface and Particles" (Kinoshita, Kyoritsu-shuppan, September 1986), particles are defined as follows (p.195, lines 22–26).

"Fine particles have a diameter in the range from 10 nm to 2 or 3 $\mu$m. In particular, when particles have a diameter in the range from 2 or 3 nm to 10 nm, they are called ultrafine particles. The term fine particle is often used to generally represent both fine particle and ultrafine particle. The above terminologies are not necessarily rigorous, and they give only rough definitions. When particles are composed of two to tens or hundreds of atoms, they are called cluster."

Furthermore, according to the "Hayashi Ultrafine Particle Project" sponsored by Research Development Corp. of Japan, the term "ultrafine particle" is used to represent particles having a particle size in the range whose lower limit is smaller than that in the above definition. That is:

"Ultrafine particle project" (1981–1986) in the creative science and technology promotion program has defined "ultrafine particle" as those particles that have a size (diameter) in the range from about 1 nm to about 100 nm. This means that one particle includes 100 to $10^8$ atoms, and thus if ultrafine particles are measured by atomic scales, they should be regarded as a "large particle or a huge particle."

("Ultrafine Particle: Creative Science and Technology", Hayashi, Ueda, Tazaki, Mita-shuppan, 1988, p.2, lines 1–4) Furthermore, in the above reference, the term "cluster" is defined as a particle having a size smaller than the ultrafine particle and including a few to hundreds of atoms.

Thus, in the present description, the term "fine particle" is used to represent an assembly of a large number of atoms or molecules whose total size is in the range from 0.1 nm or 1 nm to a few $\mu$m.

Figure 2B:
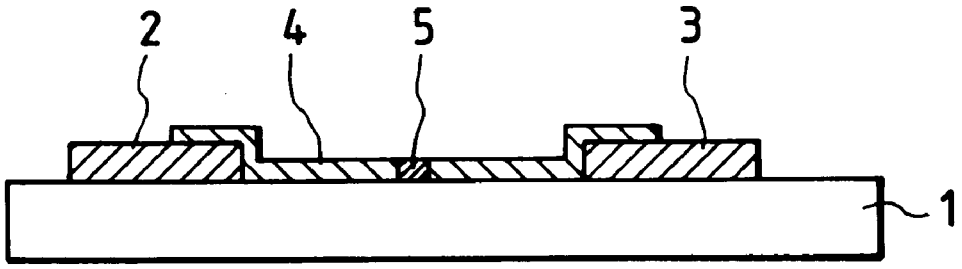
FIG. 2B PRIOR ART

Now, the surface conduction electron emitting device according to the present invention will be described in greater detail with reference to specific embodiments. The general construction of the device is shown in FIGS. 2A and 2B, which similar to that of the conventional surface conduction electron emitting device. FIGS. 1A and 1B are schematic diagrams illustrating the structure of an electron emitting region and its vicinity of a surface conduction electron emitting device according to the first embodiment of the invention. (To provide an easier understanding, the figure is deformed in scaling.) A lower potential side conductive thin film and a higher potential side conductive thin film are located at either side of an electron-emitting region formed by the energization forming process. The conductive thin film 4 is an assembly of fine particles 6 including the above-described alloy as the main constituent. The inventors of the present invention have investigated the mechanism of the electron emission from an electron emitting region. The investigation suggests that electron emission occurs as follows:

Electrons emitted from the electron-emitting region are affected by both the higher potential side of the conductive thin film and an anode electrode (although not shown) disposed above the electron emitting device, and some of them travel toward the anode electrode and the others are incident on the higher potential side of the conductive thin film. A part of the returning electrons are elastically scattered and travel toward the anode electrode again.

The electrons which have ultimately reached the anode are observed as an emission current Ie. On the other hand, those electrons absorbed by the higher potential side conductive thin film are observed as a part of a device current If.

If such mechanism of electron emission is assumed, the electron emission characteristics will be affected by the work function of the surface of the conductive thin film as will be described below.

The work function of the electron-emitting region affects the amount of electrons emitted from the electron-emitting region. With the decrease in the work function of the low-voltage side of the conductive thin film, the amount of electrons emitted increases and thus the emission current Ie increases.

The work function of the higher potential side of the conductive thin film affects the probability of elastic scattering of the incident electrons. With the decrease in the work function of the higher potential side of the conductive thin film, the probability of elastic scattering increases and thus the ratio of the emission current Ie to the device current If or the electron emission efficiency $\eta$ increases. This effect occurs not only at the first incidence of the electrons emitted from the lower potential side of the conductive thin film but also occurs when a part of the electrons which were elastically scattered once are incident again on the higher potential side of the conductive thin film.

As can be seen from the above discussion, the work function of the surface of the conductive thin film should be low enough. One technique to meet the above requirement is to cover the surface of the conductive thin film with a material having a low work function. This technique, however, has the problem that the surface of the conductive thin film, in particular the portion which contributes to electron emission, becomes locally high in temperature due to the Joule heat generated by a current or due to the energy of the incident electrons, and thus the portion of the low work function material coated on the surface is vaporized and lost, if an evaporating temperature of said material is not so high, in a rather short time. Therefore, it is difficult to maintain good electron emission characteristics for a long time.

Instead, it would be better to employ a conductive thin film which contains an element to constitute the above low work function material so that the element is continuously supplied to the portion which is losing the low work function layer thereby ensuring that good electron emission characteristics are maintained for a long time without instability.

To realize the above idea, the inventors of the present invention have made a preliminary investigation, which has revealed that it is possible to diffuse a material having a low work function into the surface of the conductive thin film if the conductive thin film is formed with fine particles of an alloy satisfying a certain condition described later. The resultant film structure has been found to be useful as the conductive thin film for use in the surface conduction electron emitting device.

The "certain condition" requires that the ionic radius of ion having the most stable ionic charge number of the metal element to constitute the low work function material is smaller than the ionic radius of ion having the most stable ionic charge number of the main constituent metal element of the alloy.

The above preliminary investigation was performed in such a manner that a fine particle film was heated in vacuum and the change in the composition of the surface of the film was observed. When the above condition was satisfied, the content of the element to constitute the low work function layer, at the surface of the fine particle film, increased with time. The reason for the above increase in the content has not been understood perfectly yet, but the inventors of the invention speculate that the heating causes the element to constitute the low work function material to precipitate at the surface of the fine particles, and the precipitated element then diffuse to the surface of the fine particle film through boundaries between fine particles. In theory based on the phase equilibrium diagram of an alloy, the element to constitute the low work function material is not always expected to precipitate from the alloy. Even in such a case, it is speculated that the extremely large surface areas of fine particles have a special contribution to precipitation.

As for the ionic radius, there are various reports on the radius for various ions. However, the reported values show some scatter arising from the difference in the conditions where ions are present and the difference in the method of determining the ionic radius. In spite of the scatter, it is still possible to determine which ion has a larger (or smaller) diameter than the other ion. Therefore, it is possible to have a discussion on the basis of the ionic radius.

Taking into account the result of the above preliminary investigation, surface conduction electron emitting devices were fabricated using a fine alloy particle film as a conductive thin film. In the actual device structure, a current flowing through the device is considered to provide a similar effect to the heating in the preliminary investigation and thus diffusion and precipitation of the element to constitute the low work function material will occur. As will be described later, the initial low work function material portion at the surface may also be formed by performing an activation process on the device in an ambient of vapor of a metallic compound including the element to constitute the low work function material portion at the surface.

In stead of the above fine alloy particle film, it is also possible to use a film composed of a mixture of fine particles of metal element serving as a main constituent and fine particles of the metal element to constitute a low work function material. In this case, no precipitation occurs but the metal element to constitute the low work function material diffuses through the boundaries between fine metal particles of main constituent toward the surface of the fine particle film.

The above requirements can be satisfied in various combinations of a metal element serving as a main constituent and a metal element to constitute a low work function material as listed below in Table 1.

TABLE 1

| Main Constituent | Low Work Function Material |
|---|---|
| Au | Y, Sc, Co, Zr, Hf, Nb, Ta, Cr, Ru, Ti, Mo, W, V, Ag, Mn, Cu, Be |
| Ag | Y, Sc, Zr, Hf, Ta, Mn |
| Pd | Sc, Co, Zr, Hf, Ni, Fe, Nb, Ta, Cr, Ru, Ti, Mo, W, V, Mn, Cu, Be |
| Mn | Sc, Zr, Hf |
| Co | Zr, Hf, Fe, Nb, Ta, Cr, Ru, Ti, Mo, W, V, Cu, Be |
| Cu | Zr, Hf, Fe, Nb, Ta, Cr, Ti, Mo, W, V |
| Zr | Hf |
| Ni | Fe, Nb, Ta, Cr, Ru, Ti, Mo, W, V, Be |
| Fe | Nb, Ta, Ti, V |
| Nb | Ti, V |
| Os | Cr, Ru, Ti, Mo, W, V, Be |
| Ir | Cr, Ru, Ti, Mo, W, V, Be |
| Pt | Cr, Ru, Ti, Mo, W, V, Be |
| Cr | Ti, V |
| Ru | Ti, Mo, W, V |
| Mo | V |
| W | V |

As shown in Table 1, in many cases, more than one kind of metal(s) can be used as the second metal element(s) corresponding to each of the first metal element. Further two or more kinds of metals can be used together as the second metal elements.

The advantages and features of the surface conduction electron emitting device according to the first and second embodiments of the invention have been described above.

Figure 3A:
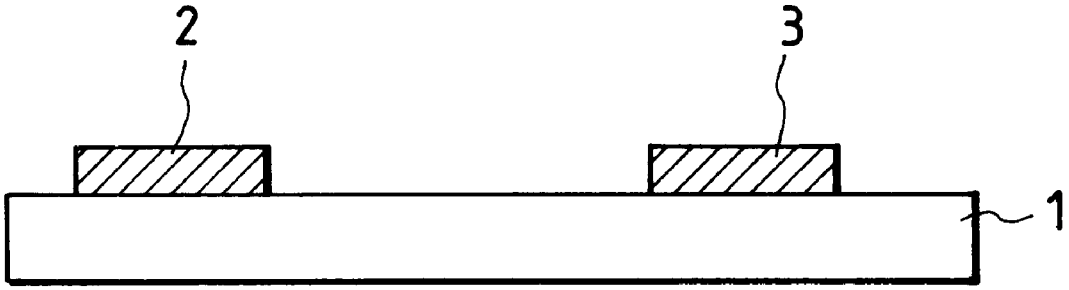
FIGS. 3A to 3C are schematic diagrams illustrating a production flow of a surface conduction electron emitting device according to the present invention.

The production method of the device according to the above first and second embodiments will be described below with reference to FIGS. 3A–3C.

(1) A substrate 1 is well cleaned with a cleaning agent, water, and organic solvent. A material for device electrodes is deposited on the substrate 1 by means of evaporation or sputtering. The material is then patterned using for example a photolithography technique so as to form device electrodes 2 and 3 (FIG. 3A).

Figure 3B:
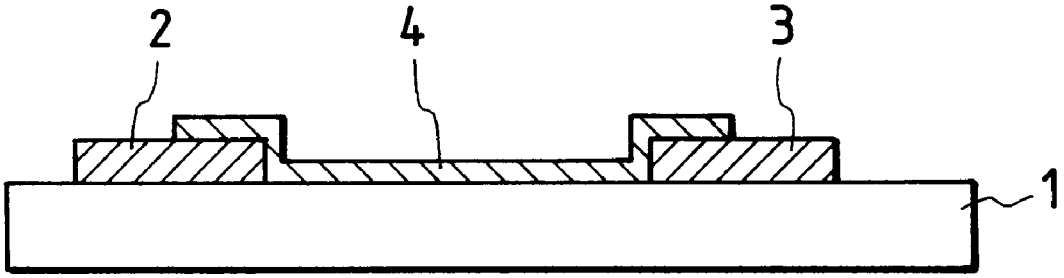
Figure 3C:
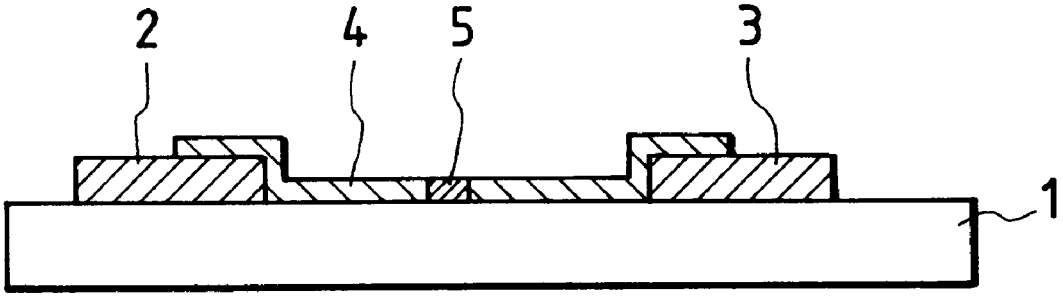

(2) A conductive thin film 4 consisting of fine alloy particles or a mixture of at least two kinds of fine metal particles is formed such that the device electrodes 2 and 3 are connected via the conductive thin film 4 (FIG. 3B).

The formation of the conductive thin film 4 may be accomplished for example by depositing an alloy film on the substrate 1 by means of sputtering with an alloy target. If the sputtering is performed at a higher pressure than employed in usual film deposition, then the resultant film has a fine particle structure rather than a continuous structure. In the case where an evaporation technique is employed, it is possible to form a fine particle film by performing evaporation in an inert gas ambient such as argon at a properly-selected pressure.

In the process of depositing a thin film by sputtering or evaporation, if two or more kinds of targets or evaporation sources are employed and if these are sputtered or evaporated alternately by opening and closing shutters, then it is possible to obtain a film consisting of a mixture of different kinds of fine particles.

It is also possible to form a desired fine particle film by coating an organometallic complex solution on the substrate and then baking it.

Figure 4A:
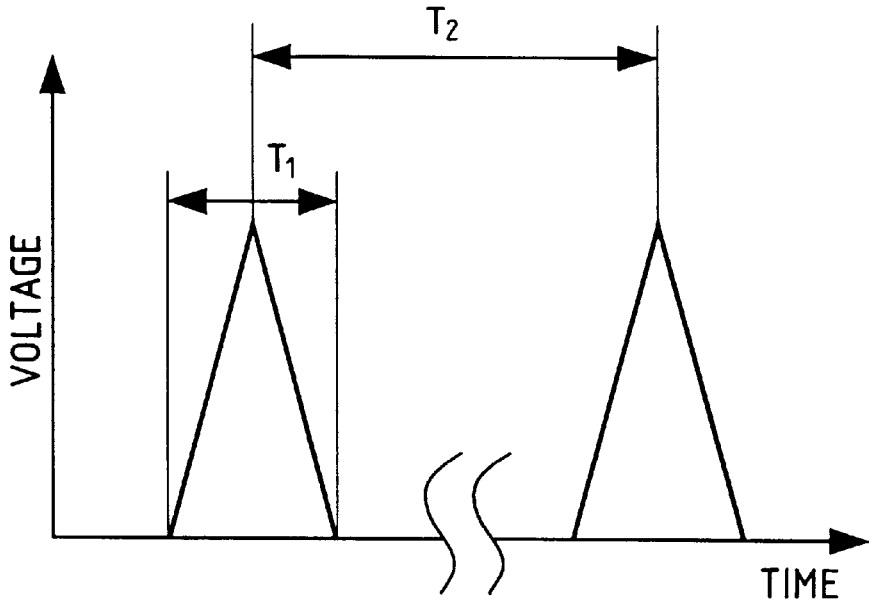
FIGS. 4A and 4B are schematic representations of the waveform of a pulse applied between device electrodes during an energization forming process in the production process according to the present invention.
Figure 4B:
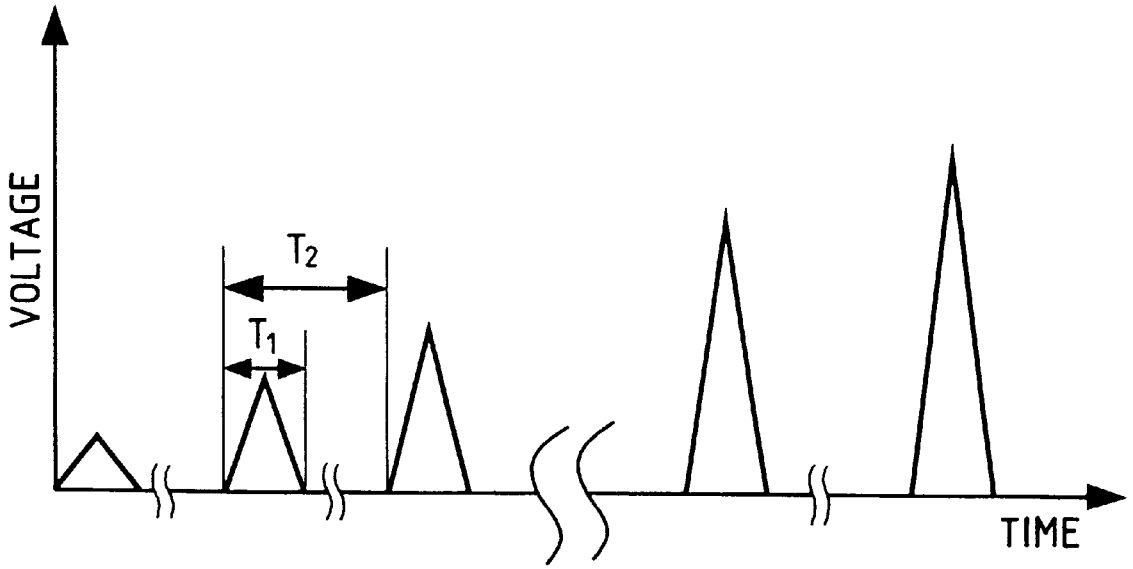

(3) The energization forming process is then performed. One specific method of the energization forming process is to conduct a current through the film as described below. If a current is conducted through the conductive thin film 4 by applying a voltage between the device electrodes 2 and 3 using a power supply (not shown), then the structure of the conductive thin film 4 is partially changed and thus an electron-emitting region 5 is formed (FIG. 3C). In the energization forming process, local breakage, deformation, or qualitative change is introduced in the conductive thin film and thus a structurally different portion is formed in the conductive thin film. The above structurally different portion serves as the electron-emitting region 5. FIGS. 4A and 4B illustrate voltage waveforms used in the energization forming process.

The voltage used in the forming process is preferably of a pulse form. A series of pulses having a constant height may be applied as shown in FIG. 4A or otherwise pulses having an increasing height may be applied as shown in FIG. 4B.

In FIG. 4A, T1 and T2 denote the pulse width and pulse interval, respectively. For most cases, T1 is set to a value in the range from 1 $\mu$sec to 10 msec, and T2 in the range from 10 $\mu$sec to 100 msec. The pulse height of the triangular waveform (which gives the peak voltage in the forming process) is selected to a proper value according to the type of the surface conduction electron emitting device. The energization forming process is performed by applying such pulses for a time period in the range from a few sec. to a few ten min. The waveform of the pulse it not limited to a triangle, but a rectangular or other proper waveforms may also be employed.

In the case of the waveform shown in FIG. 4B, T1 and T2 may also be selected to similar values to those shown in FIG. 4A. In this case, the height of the triangular pulse (the peak voltage in the forming process) is increased in steps of for example 0.1 V.

During the forming process, the resistance is monitored in each pulse interval by measuring a current which occurs when applying a voltage small enough, for example 0.1 V, not to locally destroy or deform the conductive thin film 4. When the resistance has reached a high value, for example 1 MΩ or greater, the forming process is stopped.

(4) After the forming process, the device is further subjected to an activation process as required. It is possible to achieve a great change in the device current If and emission current Ie by performing the activation process.

The activation process may be performed by applying pulses to the conductive thin film, in a similar manner to the energization forming process, in an ambient containing a vapor of a metallic compound containing a metal element to constitute the low work function material described above. The above compound contained in the ambient may be selected from the group including: metal halides such as fluorides, chlorides, bromides, and iodides of metals which meet requirements described above; metal alkyls such as methyl metal, ethyl metal, and benzyl metal; metal b-diketonate such as acetylacetonate, dipivaloylmethanate, and hexafluoroacetylacetonate; metal enyl complex such as allyl complex and cyclopentadienyl complex; arene complex such as benzene complex; metal carbonyl; metal alkoxide; and any combination of these.

The metallic compound containing an element to constitute the low work function material listed in Table 1 may be selected for example from the group including $NbF_5$, $NbCl_5$, $Nb(C_5H_5)(CO)_4Nb(C_5H_5)_2Cl_2$, $Ta(C_5H_5)(CO)_4$, $Ta(OC_2H_5)_5$, $Ta(C_5H_5)_2Cl_2$, $Ta(C_5H_5)_2H_3$, $WF_6$, $W(CO)_6$, $W(C_5H_5)_2Cl_2$, $W(C_5H_5)_2H_2$, and $W(CH_3)_6$. The film may include substance such as carbon in addition to the above metal, as required.

(5) It is desirable that the electron emitting device obtained via the above process be subjected to stabilizing process. The purpose of the stabilizing process is to remove undesirable substances such as organic molecules in the vacuum chamber and metallic compounds incorporated during the above activation process. The pumping system to evacuate the chamber is preferably of the oil free type so that the electron emitting device is not contaminated with oil which would result in unstability in the characteristics of the electron emitting device. More specifically, an adsorption pump, ion pump, or the like may be employed.

It is desirable that the partial pressure of organic compound in the vacuum chamber be less than $1.3\times10^{-6}$ Pa, and more preferably less than $1.3\times10^{-8}$ Pa, so that metal or metal compounds arising from the metallic compound introduced during the activation process and carbon or carbon compounds arising from the organic compounds said above are not newly deposited. Furthermore, it is also desirable that the entire vacuum chamber is heated when it is pumped down so that organic molecules or metallic compound molecules adsorbed on the inner wall or the electron emitting device are removed. The heating is preferably performed at a temperature in the range from 80 to 250° C., and more preferably higher than 150° C., for as long a time as possible. However, the invention is not limited to such detailed conditions, but the heating may be performed under conditions properly selected depending on the size and shape of the vacuum chamber and also depending on the structure of the electron emitting device. It is required to evacuate the vacuum chamber to as a low pressure as possible. More specifically, it is desirable that the pressure be less than $1\times10^{-5}$ Pa and more preferably less than $1.3\times10^{-6}$ Pa.

After the stabilization process, it is desirable that the ambient in which the stabilization process has been performed be maintained further in the operation of the device. However, a small increase in the pressure will be allowed to maintain stable characteristics if organic substances and metal compounds have been removed to low enough concentration levels.

If the above-described requirements regarding the vacuum ambient are satisfied, it is possible to suppress the deposition of carbon and carbon compounds as well as the incorporation of metal and metallic compounds. Thus, it is possible to remove undesirable gas such as $H_2O$ and $O_2$ absorbed on the inner wall of the vacuum chamber and on the substrate, which would otherwise result in a bad influence on the electron emission characteristics. As a result, the device current If and the emission current Ie are stabilized.

Figure 5:
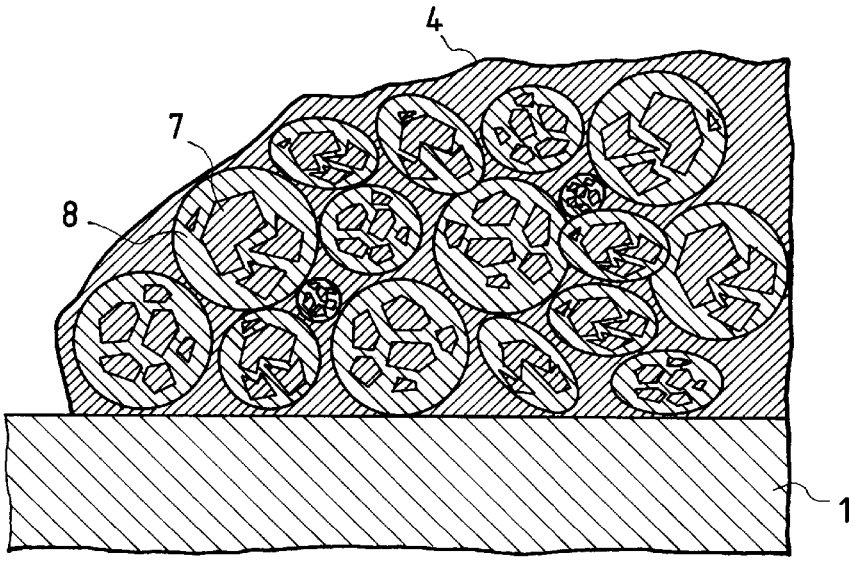
FIG. 5 is a schematic diagram illustrating the structure of an electron emitting region and its vicinity of a surface conduction electron emitting device according to a third embodiment of the invention.

The third embodiment of the invention will be described below. In the third embodiment, the conductive thin film is composed of fine particles consisting of a noble metal element serving as the main constituent element and an alkali metal element or an alkaline-earth metal element serving as the element to constitute the low work function material layer wherein the fine particles have a structure including a phase of the noble metal element wherein the phase 8 of the noble metal element further includes a phase 7 of an intermetallic compound of the noble metal element and the alkali metal element or the alkaline-earth metal element as shown schematically in FIG. 5.

It is well known that alkali metals, alkaline-earth metals, and oxides of these metals have an extremely low work function. The work functions of these metals or oxides are much lower than those of elements listed in Table 1. Therefore, if even a part of the surface of the conductive thin film is covered with such a material having a low work function, then the electron emission characteristics are improved.

However, since alkali metals and alkaline-earth metals are chemically active, if a metal layer including some alkali metal or alkaline-earth metal is exposed at the surface of fine particles, the exposed metal reacts with a small amount of residual $H_2O$ or the like which is present even in a vacuum ambient, and thus it is difficult to maintain such a metal system at a stable state.

In the present embodiment, to avoid the above problem, the phase of an intermetallic compound of a noble metal and an alkali metal or alkaline-earth metal is incorporated into the phase of the noble metal thereby achieving a stable conductive thin film composed of fine particles including the alkali metal or alkaline-earth metal. Such a conductive thin film can be formed by simultaneously evaporating metals from separate evaporation sources of a noble metal and an alkali metal or alkaline-earth metal in a proper inert gas ambient thereby depositing a mixture of metals on a substrate. In this structure, if the content of the alkali metal or alkaline-earth metal is too small, it is impossible to achieve a sufficient improvement in the electron emission characteristics. In contrast, if the content of the alkali metal or alkaline-earth metal is too large, the probability that the intermetallic compound phase is exposed at the surface of particles becomes high and the electron emission characteristics become unstable. The proper content of the alkali metal or alkaline-earth metal is in the range from 3 to 8 atomic %, while it depends on the specific combination of the noble metal and the alkali metal or alkaline-earth metal.

Alkali metal elements and alkaline-earth metal elements are more stable in terms of energy state when they are combined with oxygen than when they form an intermetallic compound. This means that if thermal energy or the like is given, alkali or alkaline-earth metal atoms in the intermetallic compound phase included in the noble metal phase can diffuse from inner part toward the surface at a rather slow rate and the alkali or alkaline-earth metal atoms which have reached the surface react with oxygen, which results in formation of a low work function material portion at the surface. Although the low work function material is lost during the operation of the device, it is continuously supplied via the above-described diffusion from inner part toward the surface. As a result, the low work function material layer is preserved without being lost. As described earlier, if only a part of the surface of the conductive thin film is coated with a low work function material layer including an alkali metal or alkaline-earth metal, it is enough to obtain the above effect. This means that a slow rate of supply of the alkali metal or alkaline-earth metal via the diffusion is sufficient to maintain the effect for a long time.

The basis characteristics of the electron emitting device fabricated via the above-described processes according to the present invention are described below with reference to FIGS. 6 and 7.

Figure 6:
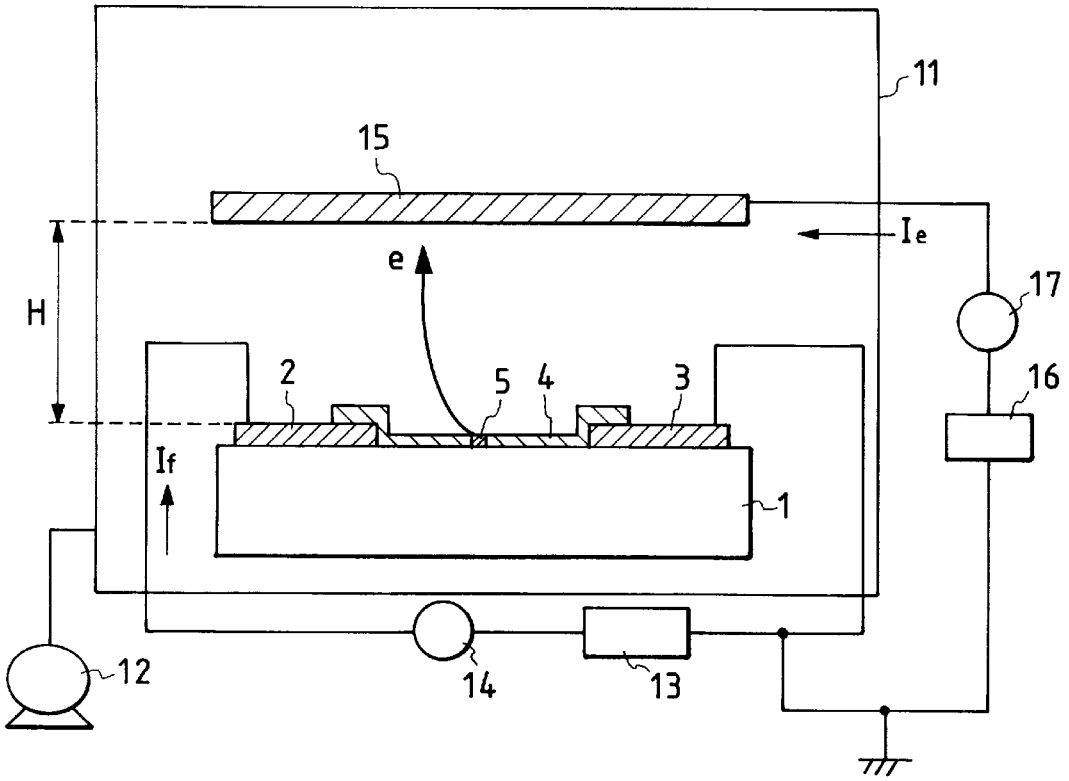
FIG. 6 is a schematic diagram illustrating the construction of a vacuum processing apparatus used to produce a surface conduction electron emitting device according to the present invention and also used to evaluate the electron emission characteristics thereof.

FIG. 6 is a schematic diagram illustrating an example of a vacuum processing apparatus which also serves as a measurement and evaluation apparatus.

In FIG. 6, reference numeral 11 denotes a vacuum chamber, and reference numeral 12 denotes an evacuation pump. An electron emitting device is placed in the vacuum chamber 11. Reference numeral 13 denotes a power supply source for applying a device voltage Vf to the electron emitting device. Reference numeral 14 denotes an ammeter for measuring the device current If flowing through the conductive thin film 4 disposed between the device electrodes 2 and 3. Reference numeral 15 denotes an anode electrode for capturing the emission current Ie caused by emitted electrons from the electron emitting region 5. Reference numeral 16 denotes a high-voltage power supply source for applying a voltage to the anode 15. Reference numeral 17 denotes an ammeter for measuring the emission current Ie caused by emitted electrons from the electron emitting region 5. The voltage of the anode electrode is preferably set to a value in the range from 1 kV to 10 kV. The distance between the anode electrode and the electron emitting device is preferably set to a value in the range from 2 mm to 8 mm.

In the vacuum chamber 11, there is provided a device such as a vacuum gauge (not shown) for evaluating the vacuum conditions under which the electron emitting device is evaluated. The evacuation pump 12 consists of a usual high-vacuum pumping system including a rotary pump and a turbo-molecular pump and also an ultra-high vacuum pumping system including an ion pump. The entire vacuum processing apparatus in which the electron source substrate is placed can be heated by a heater (not shown). Therefore, this vacuum processing apparatus can be used to perform the forming process described above and other processes following that.

Figure 7:
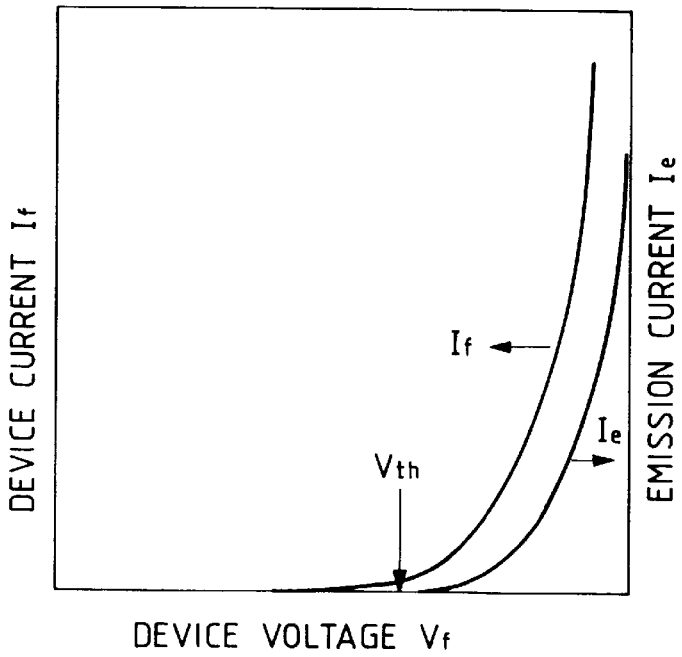
FIG. 7 is a graph illustrating the electron emission characteristics of the surface conduction electron emitting device according to the present invention.

FIG. 7 is an illustrative graph of the emission current Ie and the device current If versus the device voltage Vf wherein these characteristics are measured using the vacuum processing apparatus shown in FIG. 6. In FIG. 7, the emission current Ie is extremely small compared to the device current If and thus currents are represented in arbitrary units wherein linear scales are employed in both vertical and horizontal axes.

As can be seen from FIG. 7, the surface conduction electron emitting device of the invention has three features regarding the emission current Ie as described below:

(i) When a voltage greater than a certain value (referred to as a threshold voltage, denoted by Vth in FIG. 7) is applied to the surface conduction electron emitting device, the emission current Ie increases very sharply with the increase in the applied voltage. On the other hand, when the applied voltage is less than the threshold voltage Vth, substantially no emission current Ie is detected. This means that the surface conduction electron emitting device of the invention is a nonlinear device having a distinct threshold voltage Vth at which a drastic change in the emission current Ie occurs.

(ii) The emission current Ie increases monotonically with the change in the device voltage Vf, and thus it is possible to control the emission current Ie simply by controlling the device voltage Vf.

(iii) The total emission charge captured by the anode electrode 25 depends on how long the device voltage Vf is applied. This means that it is possible to control the total emission charge captured by the anode electrode 54 by controlling the device voltage application time.

As can be seen from the above description, the electron emission characteristics of the surface conduction electron emitting device of the invention change in response to the applied signal and thus it is easy to control the change in the electron emission characteristics. This property makes it possible to realize an electron source on which a great number of electron emitting devices are disposed and also an image display device using such an electron source which can be used in a wide variety of applications.

When the electron emission characteristics of the surface conduction electron emitting device according to the first, second, or third embodiment of the invention are degraded, it is possible to recover the characteristics using the method described below.

If a voltage lower than the usual driving voltage employed to induce electron emission is applied to the device, then a slight degradation in characteristics which may occur after a long-term operation can be recovered.

Such recovery occurs for the following reasons. Even if the low work function material layer coated on the surface of the conductive thin film is gradually lost during the operation, the element required to lower the work function is supplied from the inner portion of the conductive thin film and the low work function is maintained. However, some portions of the device encounter a severe condition and the low work function material layer in such portions is lost quickly, as is the case at a higher potential side of the electron-emitting region and at the end portion of the higher potential side of the conductive thin film. For such portions, the supply of the above element is not sufficient, and some degradation can occur. After such degradation, if a voltage lower than the normal operating voltage is applied, then the consumption of the low work function material is suppressed while the above-described element is supplied from the inner portion until the characteristics are recovered. The voltage applied during this recovering process should be greater than the threshold voltage in terms of If-Vf characteristic. If the applied voltage is lower than the threshold voltage, no current flows through the device, and energy required for the diffusion or transportation of the element is not given to the device.

In the specific example shown in FIG. 7, the device current If increases monotonically with the device voltage Vf. However, in some cases, the characteristic of device current If versus device voltage Vf shows a voltage-controlled negative resistance. The characteristic of device current If versus device voltage Vf can be controlled by controlling the processes described above.

Now, an electron source on which a plurality of surface conduction electron emitting devices described above are arranged and also an image forming apparatus realized with such an electron source will be described below.

The surface conduction electron emitting devices may be disposed in various fashions.

One method of disposing surface conduction electron emitting devices is to dispose a plurality of devices along a line called a device row so that one end of the respective devices is connected in common to each other and the other end of the respective devices is connected in common to each other thereby achieving ladder-shaped interconnections. A plurality of similar device rows are disposed in parallel, and control electrodes (also referred to as grids) are disposed above the electron emitting devices in the direction (column direction) perpendicular to the above device row. The electron emission of the electron emitting devices is controlled via these control electrodes. Another method is to dispose a plurality of surface conduction electron emitting devices along both the X-direction and Y-direction in a simple matrix form in which one electrode of each electron emitting device disposed in the same row is connected in common to an interconnection disposed along the X-direction whereas the other electrode of each electron emitting device disposed in the same column is connected in common to another interconnection disposed along the Y-direction. This device arrangement is referred to as a simple matrix arrangement which will be described in further detail below.

The surface conduction electron emitting device of the invention has features (i) to (iii) described above. That is, in the voltage range greater than the threshold voltage, the emission current from the surface conduction electron emitting device can be controlled by controlling the height and width of a pulse applied between the device electrodes disposed at opposite locations. On the other hand, in the voltage range less than the threshold voltage, substantially no electron emission occurs. This property can be used to control an array of a large number of electron emitting devices. That is, if a proper voltage in the form of a pulse is applied separately to the individual devices, then the amounts of electron emission of the desired surface conduction electron emitting devices change in response to the input signal. Thus, it is possible to select a desired surface conduction electron emitting device and control the amount of electron emission of that device.

Figure 8:
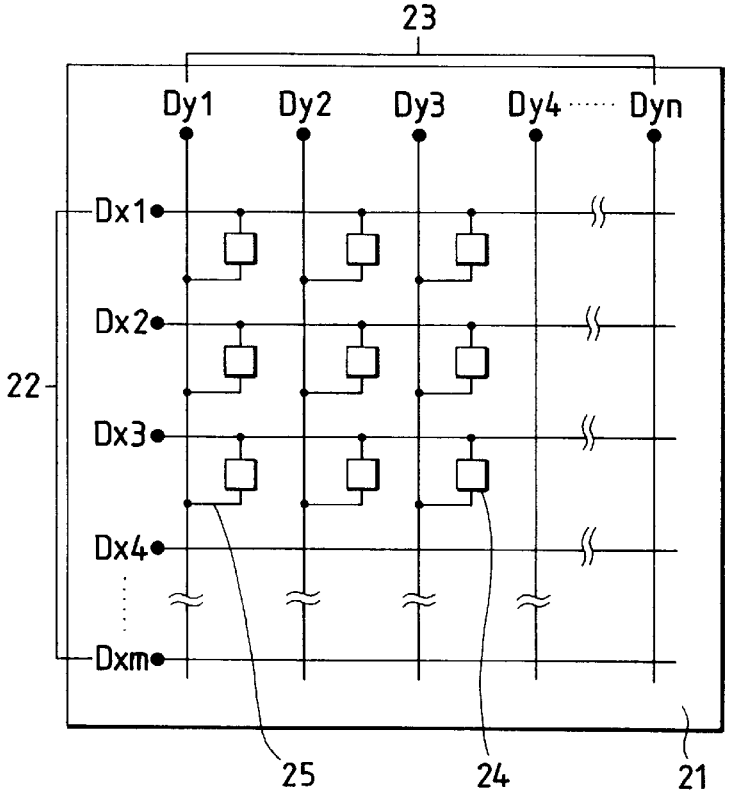
FIG. 8 is a schematic diagram illustrating interconnections disposed in a matrix form of an electron source according to the present invention.

An electron source substrate on which a large number of electron emitting devices of the invention are disposed will be described below with reference to FIG. 8. In FIG. 8, reference numeral 21 denotes an electron source substrate, reference numeral 22 denotes interconnections along the X-direction, and reference numeral 23 denotes interconnections along the Y-direction. Reference numeral 24 denotes a surface conduction electron emitting device, and reference numeral 25 denotes an interconnection. The interconnections 22 along the X-direction include m lines Dx1, Dx2, . . . , Dxm, which may be formed with an electrically-conductive metal or the like by means of evaporation, printing, or sputtering. The material, thickness, and width of the interconnection are selected to meet the requirements of a specific application. The interconnections 23 along the Y-direction include n lines Dy1, Dy2, . . . , Dyn which may be formed in a similar manner to the interconnections 22 along the X-direction. These m interconnections 22 along the X-direction and n interconnections 23 along the Y-direction are electrically isolated from each other by an interlayer insulating film (not shown) wherein m, n are a positive integer.

The interlayer insulating film (not shown) is formed of $SiO_2$ or the like by means of evaporation, printing, or sputtering. For example, the interlayer insulating film is formed either over the entire area of the substrate 21 on which the interconnections 22 are formed along the X-direction or partially in desired areas wherein the thickness and material of the interlayer insulating film and the method of forming it are properly selected so that the interlayer insulating film can withstand the voltage which appears between the interconnections 22 along the X-direction and the interconnections 23 along the Y-direction at portions where they cross each other. The interconnections 22 along the X-direction and the interconnections 23 along the Y-direction are each connected to a corresponding external terminal.

Furthermore, the device electrodes (not shown) of the respective surface conduction electron emitting devices 24 are electrically connected to each other via m interconnections 22 along the X-direction, n interconnections 23 along the Y-direction, and conductive metal interconnections 25.

The materials of the interconnections 22 and 23, the material of the interconnections 25, and the material of each pair of device electrodes may be absolutely equal, partially equal, or different. These materials may be selected from the group of materials for the device electrodes listed above. When the device electrodes and the interconnections are formed with the same material, the interconnections connected to the device electrodes can be regarded as device electrodes.

The interconnections 22 along the X-direction are electrically connected to scanning signal applying means (not shown) so that a scanning signal generated by the scanning signal applying means is applied to a device row via the interconnections 22 along the X-direction thereby selecting the surface conduction electron emitting devices 24 disposed in the X-direction row. On the other hand, the interconnections 23 along the Y-direction are electrically connected to modulation signal generation means (not shown) so that a modulation signal generated by the modulation signal generation means is applied via the interconnections 23 along the Y-direction to the surface conduction electron emitting devices 24 disposed in each Y-direction column thereby modulating these surface conduction electron emitting devices according to the input signal. A voltage equal to the difference between the scanning signal and the modulation signal is applied as a driving voltage to each surface conduction electron emitting device.

In the arrangement described above, any desired device can be selected and can be driven independently via the interconnections in the simple matrix form.

Figure 9:
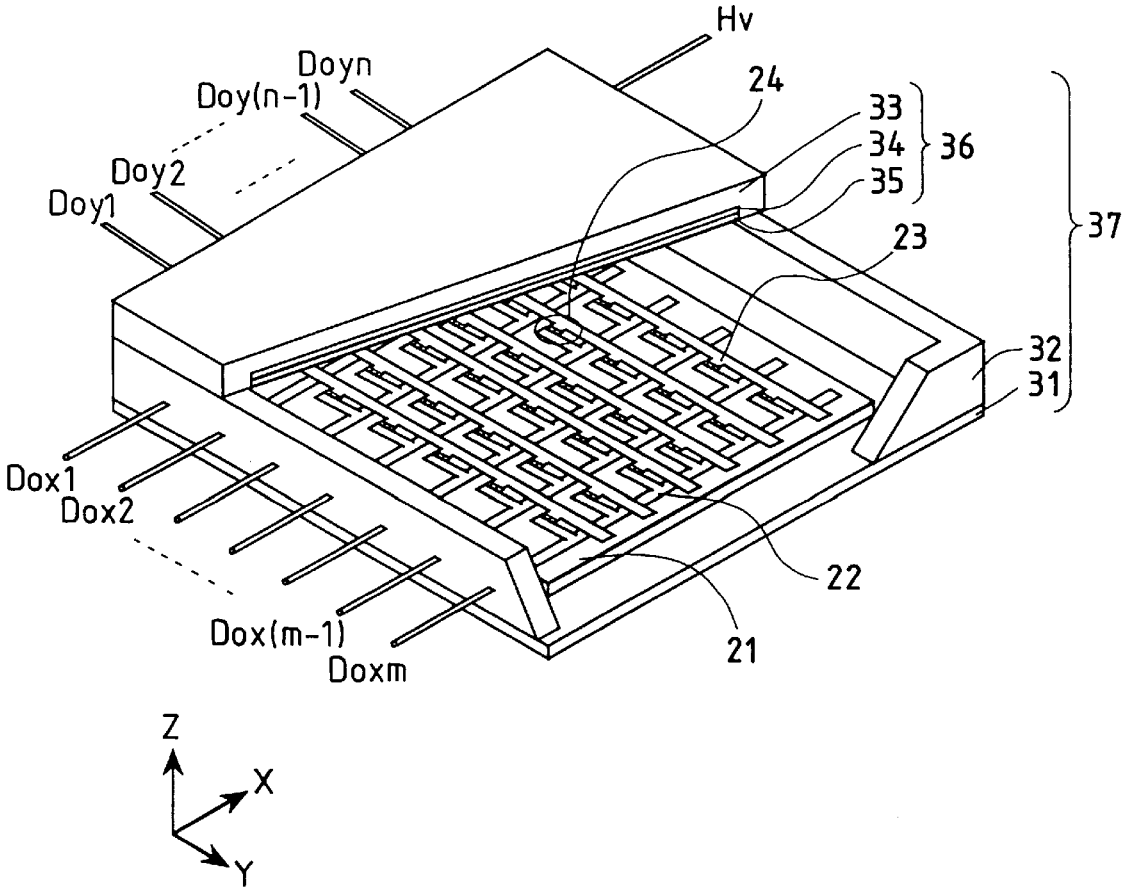
FIG. 9 is a schematic diagram illustrating the structure of an image forming apparatus using an electron source provided with interconnections in the form of a matrix.
Figure 10A:
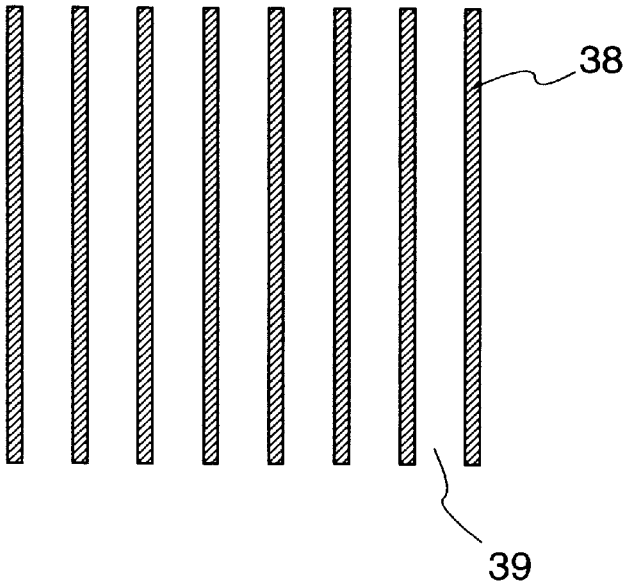
FIGS. 10A and 10B are schematic diagrams illustrating an example of the pattern of a fluorescent film used in the image forming apparatus according to the present invention.
Figure 10B:
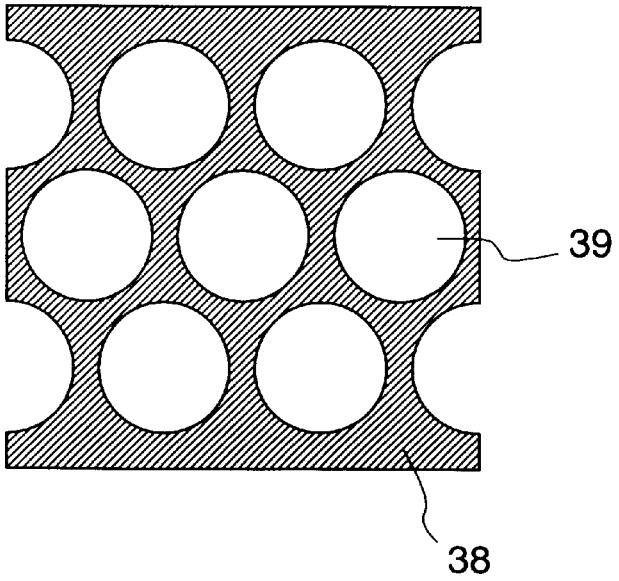
Figure 11:
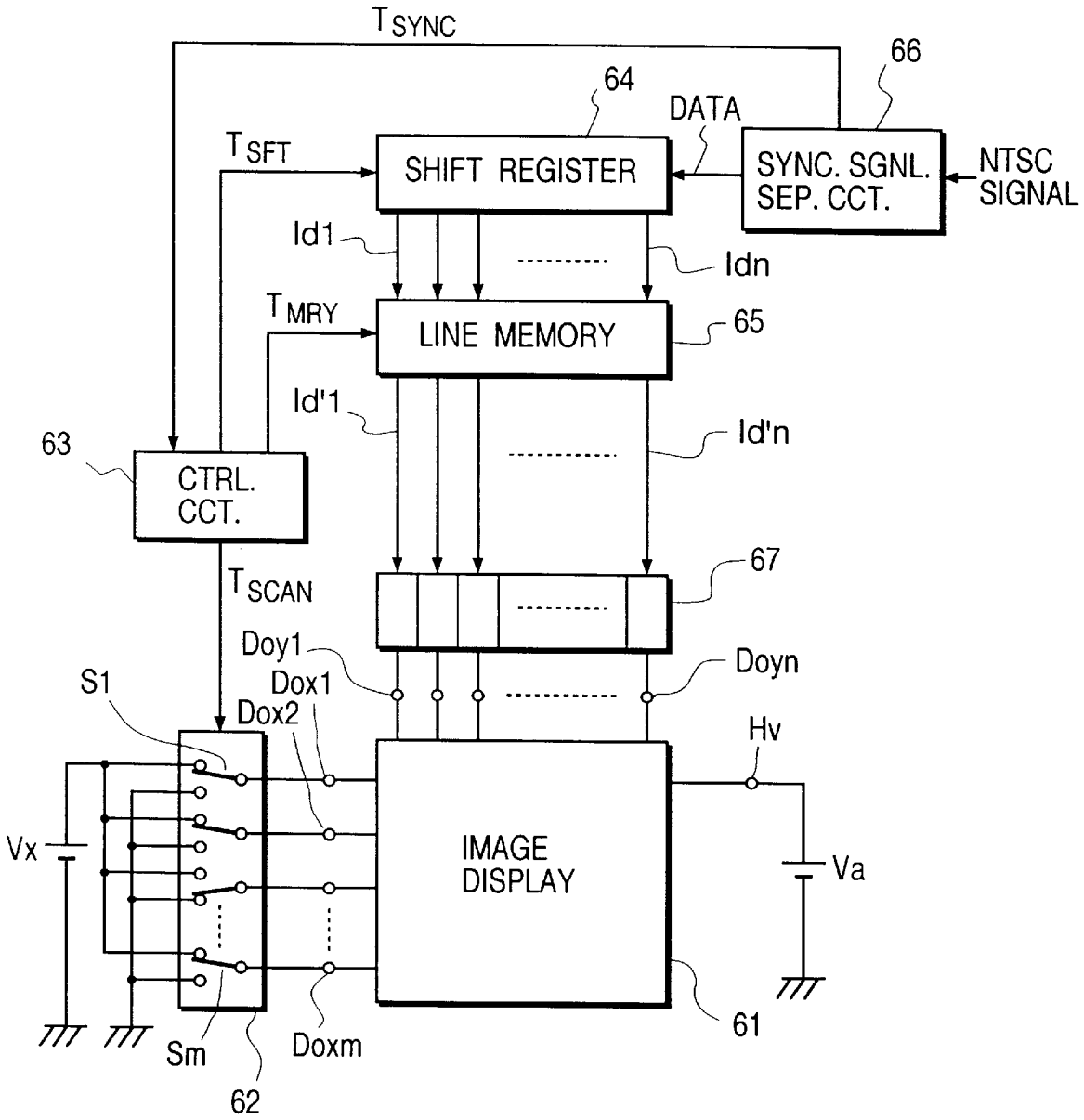
FIG. 11 is a circuit diagram, in block form, of a circuit for displaying an image on the image forming apparatus of the invention in response to an image signal according to the NTSC standard.

Referring to FIGS. 9, 10A, 10B, and 11, an image forming apparatus constructed with an electron source having simple matrix interconnections formed in the above-described manner will be described below. FIG. 9 is a schematic diagram illustrating an example of an image display device of an image forming apparatus, and FIGS. 10A and 10B are schematic diagrams illustrating a fluorescent film used in the image-forming apparatus shown in FIG. 9. FIG. 11 is a block diagram illustrating an example of a driving circuit used to drive the image forming apparatus so as to display an image according to a given NTSC TV signal.

In FIG. 9, reference numeral 21 denotes an electron source substrate on which a plurality of electron emitting devices are arranged, 31 denotes a rear plate on which the electron source substrate 21 is fixed, and 36 denotes a face plate consisting of a glass substrate 33 whose inner surface is covered with a fluorescent film 34 which is further backed with a metal back 35. Reference numeral 32 denotes a supporting frame to which the rear plate 31 and the face plate 36 are fixed via frit glass or the like.

Reference numeral 24 denotes a portion corresponding to the electron emitting region shown in FIG. 2A or 2B. Reference numerals 22 and 23 denote an interconnection along the X-direction and an interconnection along the Y-direction, respectively, connected to a pair of device electrodes of each surface conduction electron emitting device.

As described above, the envelope 37 is composed of the face plate 36, the supporting frame 32, and the rear plate 31. The principal purpose of the rear plate 31 is to reinforce the mechanical strength of the electron source substrate 21. If the electron source substrate 21 itself has an enough mechanical strength, the rear plate 31 is no longer necessary. In such a case, the supporting frame 32 may be directly connected to the electron source substrate 21 so that the envelope 37 is formed with the face plate 36, the supporting frame 32, and the electron source substrate 21. On the other hand, it is also possible to construct an envelope 37 having a sufficiently large strength against the atmospheric pressure by disposing a supporting element called a spacer (not shown) between the face plate 36 and the rear plate 31.

FIGS. 10A and 10B are a schematic diagram illustrating a fluorescent film. In the case of monochrome, the fluorescent film 34 simply consists of a phosphor. However, in the case of a color fluorescent film, the fluorescent film includes a phosphor 39 and a black conductor 38, which is called a black stripe or a black matrix depending on the arrangement of the phosphor. In color display devices, black matrix or black stripes are disposed at boundaries between phosphors 39 of three primary colors so as to reduce mixture of colors. The black stripes (black matrix) also prevent a reduction in contrast due to reflection of external light at the fluorescent film 34. The black stripe is usually made up of a material containing graphite as a main ingredient. Other materials having electric conductivity and low transmittance and low reflectance to light may also be employed.

The phosphor may be coated on the glass substrate 33 by means of deposition or printing in either case of monochrome or color fluorescent film. The inner side of the fluorescent film 34 is usually covered with a metal back 35. One purpose of the metal back is to directly reflect light, which is emitted by the phosphor toward the inside, to the face plate 36 thereby increasing the brightness. Another purpose is to act as an electrode to which a voltage (electron beam acceleration voltage) is applied so as to accelerate an electron beam. Furthermore, the metal back protects the phosphor from being damaged by collision of negative ions generated in the envelope. The metal back is formed as follows. First a fluorescent film is formed. The inner surface of the fluorescent film is smoothed (this smoothing process is usually called filming). Then, Al is deposited on the fluorescent film by means of for example evaporation.

The face plate 36 may also be provided with a transparent electrode (not shown) on the outer side of the fluorescent film 34 so as to increase the conductivity of the fluorescent film 34.

In the case of a color image forming apparatus, when components are combined and sealed into a unit, phosphors of respective colors have to be disposed at correct locations corresponding to electron emitting devices, and thus accurate positioning is required.

An example of a production method of the image forming apparatus shown in FIG. 9 will be described below.

Figure 12:
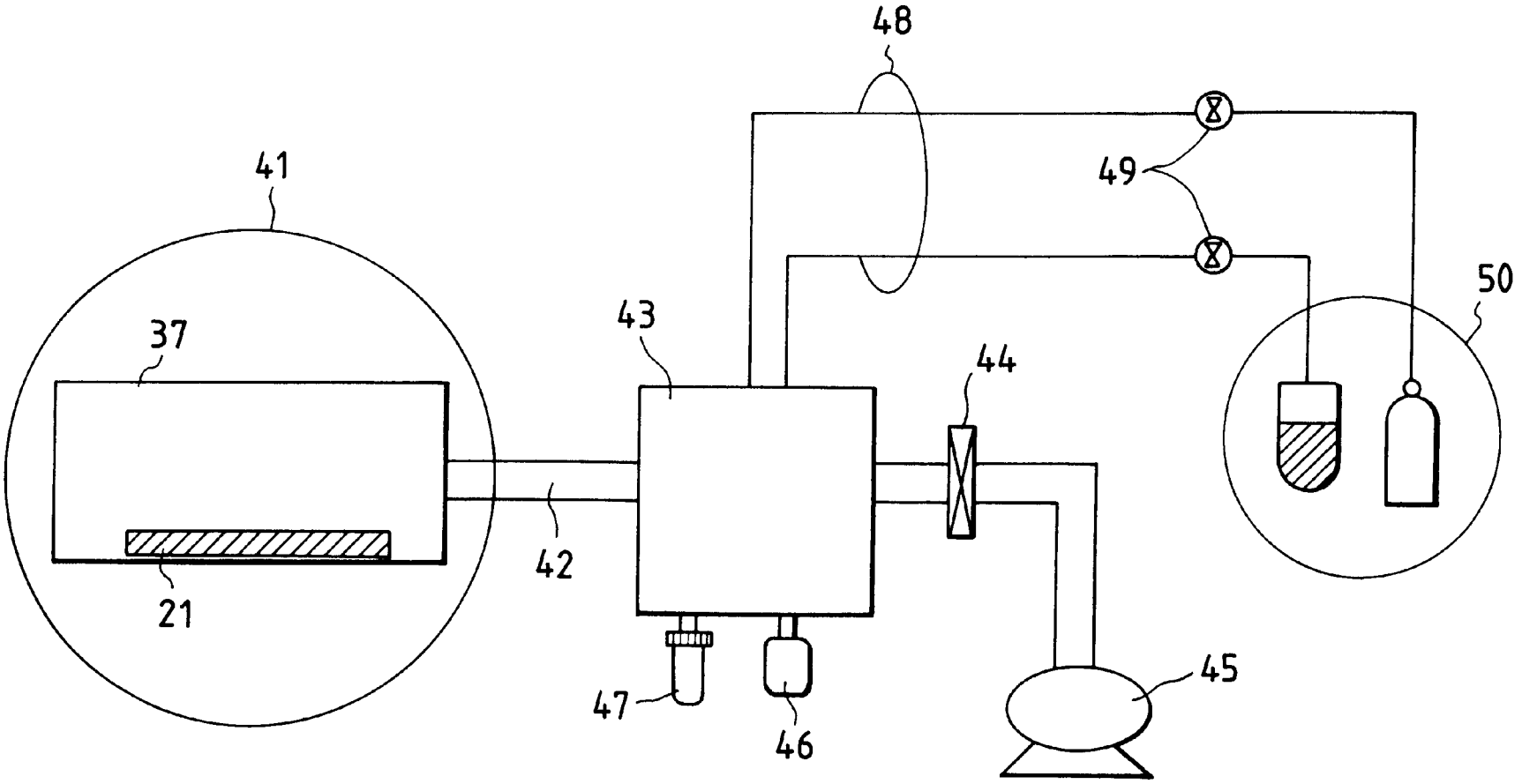
FIG. 12 is a schematic diagram illustrating the construction of a vacuum processing apparatus used to produce an image forming apparatus according to the present invention.

FIG. 12 is a schematic diagram of an apparatus used in the production of the image forming apparatus. An image forming apparatus 41 is connected to a vacuum chamber 43 via an evacuation pipe 42 while the vacuum chamber 43 is connected to an evacuation system 45 via a gate valve 44. The vacuum chamber 43 is provided with a pressure gauge 46 and a quadrupole mass spectrometer 47 for measuring the pressure and the partial pressures of various gas components in the ambient inside the vacuum chamber. Since it is difficult to directly measure the pressure inside the envelope 37 of the image forming apparatus 41, the pressure is determined indirectly by measuring the pressure in the vacuum chamber 43. The process conditions are controlled according to the measured pressure.

Gas lines 48 are connected to the vacuum chamber 42 so that gases required to control the ambient in the vacuum chamber are introduced into the vacuum chamber. The other ends of the gas lines 48 are connected to gas sources 50 in the form of a gas cylinder or an ample. In the middle of the gas lines, there are provided flow rate control means 49 for controlling the flow rates of the gases. Various types of devices may be employed as the flow rate control means 49 depending on the kinds of gases to be introduced into the vacuum chamber. They include a valve having the capability of controlling the amount of leakage gas such as a slow leak valve and a mass flow controller.

Figure 13:
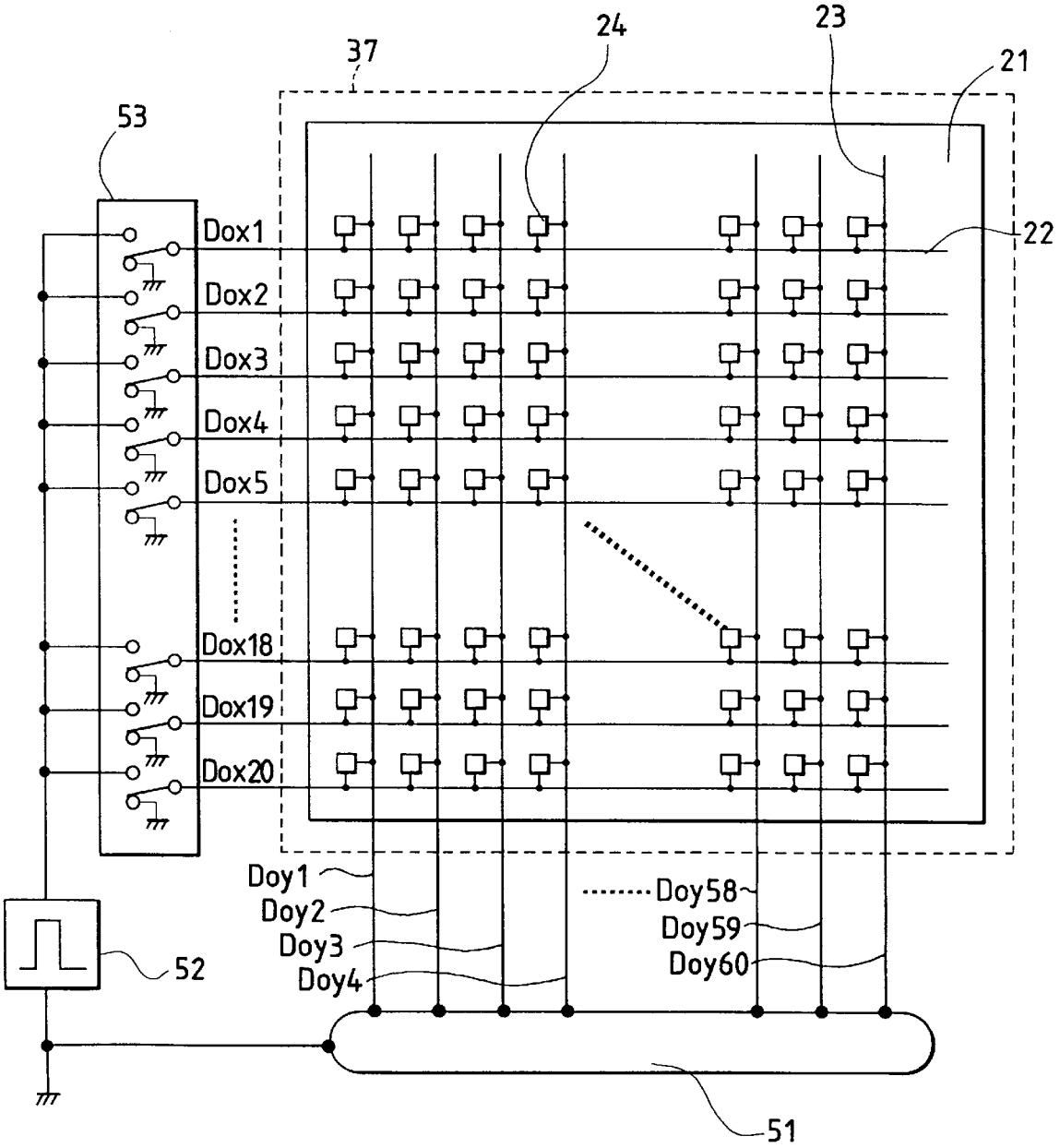
FIG. 13 is a schematic diagram illustrating a circuit configuration used in the energization forming process and the activation process in the production process of the electron source and the image forming apparatus according to the present invention.

Using the apparatus shown in FIG. 12, the inside of the envelope 37 is evacuated and subsequently the energization forming process is performed. In the energization forming process, as shown in FIG. 13, interconnections 23 along the Y-direction are connected in common to a common electrode 51 and one interconnection 22 along the X-direction is selected from a plurality of similar interconnections in the X-direction by a row selection means 53, and a voltage pulse is simultaneously applied from a power supply 52 to all devices 24 along the selected row thereby performing the forming process. The waveform of the pulse and the ending conditions may be properly selected in a similar manner to the discrete device described earlier. Furthermore, if pulses are applied to a plurality of interconnections along the X-direction so that the respective pulses have different phases thereby switching the rows one by one (this technique is called scrolling) then all devices along the different rows are subjected to the energization forming process row to row.

After the forming process, activation is performed. The inside of the envelope 37 is evacuated to a sufficiently low pressure. A metallic compound gas is then introduce via a gas line 48.

In the ambient including the metallic compound achieved in the above-described manner, a voltage is applied to the respective electron emitting devices so that a metal is deposited in a limited area including the electron emitting region thereby achieving an increase in the electron emission as in the discrete device described earlier. The above voltage application can be performed by supplying a voltage pulse to the devices via a selected interconnection along the X-direction as in the energization forming process. Or otherwise, activation may be performed on all devices by means of scrolling.

After the activation process, it is desirable to perform stabilization as in the discrete device. The inside of the envelops 37 is evacuated by the oil-free evacuation system 45 consisting of such as an ion pump and an adsorption pump via the evacuation pipe 42 while heating the envelope at 80 to 250° C., thereby removing the organic substance and the metallic compound introduced in the activation process. Then the evacuation pipe is sealed by heating it by a burner. If required, gettering is performed so as to maintain a low enough pressure after the envelope 37 is sealed. In the gettering process, a gettering material (not shown) disposed in a predetermined position in the envelope 37 is heated by means of resistance heating or RF heating immediately before or after sealing the envelope 37 thereby evaporating the gettering material. A typical gettering material includes Ba as a main constituent. The evaporated gettering material has the adsorbing ability which allows the ambient in the envelope 37 to be maintained at a low pressure.

Referring to FIG. 11, an example of the circuit configuration of the driving circuit for driving the image display device apparatus constructed with the electron source of the simple matrix type so that a television image is displayed thereon according to an NTSC television signal will be described below. In FIG. 11, reference numeral 61 denotes an image display device, 62 denotes a scanning circuit, 63 denotes a control circuit, and 64 denotes a shift register. Furthermore, reference numeral 65 denotes a line memory, 66 denotes a synch signal separation circuit, 67 denotes a modulation signal generator, and Vx and Va denote DC voltage sources.

The image display device 61 is connected to external electric circuits via terminals Dox1 to Doxm, terminals Doy1 to Doyn, and a high-voltage terminal Hv. The electron source disposed in the display panel is driven via these terminals as follows. A scanning signal is applied via the terminals Dox1 to Doxm to the surface conduction electron emitting devices arranged in the form of an m×n matrix so as to drive these devices row by row (n devices at a time)

On the other hand, via the terminals Doy1 to Doyn, a modulation signal is applied to each surface conduction electron-emitting device disposed in the line which is selected by the above-described scanning signal, thereby controlling the electron beam emitted by each device. A DC voltage of for example 10 kV is supplied from the DC voltage source Va via the high-voltage terminal Hv. This voltage is used to accelerate the electron beam emitted from each surface conduction electron emitting device so that the electrons gain high enough energy to excite the phosphor.

The scanning circuit 62 operates as follows. The scanning circuit 62 includes m switching elements (S1 to Sm in FIG. 11). Each switching element selects either the voltage Vx output by the DC voltage source or 0 V (ground level) so that the selected voltage is supplied to the image display device 61 via the terminals Dx1 to Dxm. Each switching element S1 to Sm is formed with a switching device such as an FET. These switching elements S1 to Sm operate in response to the control signal Tscan generated by the control circuit 63.

The output voltage of the DC voltage source Vx is set to such a fixed value that devices which are not scanned are supplied with a voltage less than the electron emission threshold voltage of the surface conduction electron emitting device.

The control circuit 63 is responsible for controlling various circuits so that an image is correctly displayed according to an image signal supplied from the external circuit. In response to the sync signal Tsync received from the sync signal separation circuit 66, the control circuit 63 generates control signals Tscan, Tsft, and Tmry and sends these control signals to the corresponding circuits.

The sync signal separation circuit 66 is constructed with a common filter circuit in such a manner as to extract a sync signal component and a luminance signal component from an NTTS television signal supplied from an external circuit. Although the sync signal extracted by the sync signal separation circuit 66 is simply denoted by Tsync in FIG. 11, the practical sync signal consists of a vertical sync signal and a horizontal sync signal. The image luminance signal component extracted from the television signal is denoted by DATA in FIG. 11. This DATA signal is applied to the shift register 64.

The shift register 64 receives a DATA signal in serial form in terms of time and converts it to a signal in parallel form line by line of an image. The above-described conversion operation of the shift register 64 is performed in response to the control signal Tsft generated by the control circuit 63 (this means that the control signal Tsft acts as a shift clock signal to the shift register 64). After being converted into the parallel form, one line of image data consisting of N parallel signals Id1 to Idn is output from the shift register 64 (thereby driving N electron emitting devices).

The line memory 65 stores one line of image data for a required time period. That is, the line memory 65 stores the data Id1 to Idn under the control of the control signal Tmry generated by the control circuit 63. The contents of the stored data are output as data I'd1 to I'dn from the line memory 65 and applied to the modulation signal generator 67.

The modulation signal generator 67 generates signals according to the respective image data I'd1 to I'dn so that each surface conduction electron emitting device is properly driven by the corresponding modulation signals generated by the modulation signal generator 67 wherein the output signals of the modulation signal generator 67 are applied to the surface conduction electron emitting devices of the image display device 61 via the terminal Doy1 to Doyn.

The electron emitting device used in the present invention has basic characteristics in terms of the emission current Ie as described below. In the emission of electrons, there is a distinct threshold voltage Vth. That is, electron emission occurs only when a voltage greater than the threshold voltage Vth is applied to an electron emitting device. In the case where the voltage applied to the electron emitting device is greater than the threshold voltage, the emission current varies with the variation in the applied voltage. Therefore, when a voltage in the form of a pulse is applied to the electron emitting device, if the voltage is greater than the threshold voltage an electron beam is output while no electron emission occurs if the voltage is less than the threshold voltage. In the above operation, it is possible to control the intensity of the electron beam by varying the height Vm of the pulse. Furthermore, it is also possible to control the total amount of charge carried by the electron beam by varying the pulse width Pw.

As can be seen from the above discussion, either a technique based on the voltage modulation or a technique based on the pulse width modulation may be employed to control the electron emitting device so that the electron emitting device emits electrons according to the input signal. When the voltage modulation technique is employed, the modulation signal generator 67 is designed to generate a pulse having a fixed width and having a height which varies according to the input data.

On the other hand, if the pulse width modulation technique is employed, the modulation signal generator 67 is designed to generate a pulse having a fixed height and having a width which varies according to the input data.

The shift register 64 and the line memory 65 may be either of analog type or of digital type as long as the serial-to-parallel conversion of the image signal and the storage operation are correctly performed at a desired rate.

When the digital technique is employed for these circuits, an analog-to-digital converter is required to be connected to the output of the sync signal separation circuit 66 so that the output signal DATA of the sync signal separation circuit 66 is converted from analog form to digital form. Furthermore, a proper type of modulation signal generator 67 should be selected depending on whether the line memory 65 outputs digital signals or analog signals. When a voltage modulation technique using digital signals is employed, the modulation signal generator 67 is required to include a digital-to-analog converter and an amplifier is added as required. In the case of the pulse width modulation, the modulation signal generator 67 is constructed for example with a combination of a high speed signal generator, a counter for counting the number of pulses generated by the signal generator, and a comparator for comparing the output value of the counter with the output value of the above-described memory. If required, an amplifier is further added to the above circuit so that the voltage of the pulse-width modulation signal output by the comparator is amplified to a voltage large enough to drive the surface conduction electron emitting devices.

On the other hand, in the case where a voltage modulation technique using analog signals is employed, an amplifier such as an operational amplifier is used as the modulation signal generator 67. A level shifter is added to that if required. In the case where the pulse width modulation technique is coupled with the analog technique, a voltage controlled oscillator (VCO) can be used as the modulation signal generator 67. If required, an amplifier is further added to the above circuit so that the output voltage of the VCO is amplified to a voltage large enough to drive the surface conduction electron emitting devices.

In the image display device constructed in the above-described manner according to the present invention, electrons are emitted by applying a voltage to each electron emitting device via the external terminals Dox1 to Doxm, and Doy1 to Doyn. The emitted electrons are accelerated by a high voltage which is applied via the high voltage terminal Hv to a back-metal 85 or a transparent electrode (not shown). The accelerated electrons strike a fluorescent film 84 and thus light is emitted from the fluorescent film. As a result, an image is formed by light emitted from the fluorescent film.

While the image forming apparatus of the present invention has been described above with reference to a preferred embodiment thereof, the invention is not limited to the details shown, since various modifications in the construction or the material are possible. Furthermore, although it is assumed in the above description that an input signal according to the NTSC standard is used, an input signal according to another standard such as PAL or SECAM may also be employed. A TV signal consisting of a greater number of lines than those of the above standards may also be employed (such standards include the MUSE and other the high definition television standards).

The ladder-type electron source and an image forming apparatus using such the electron source will be described below with reference to FIGS. 14 and 15.

Figure 14:
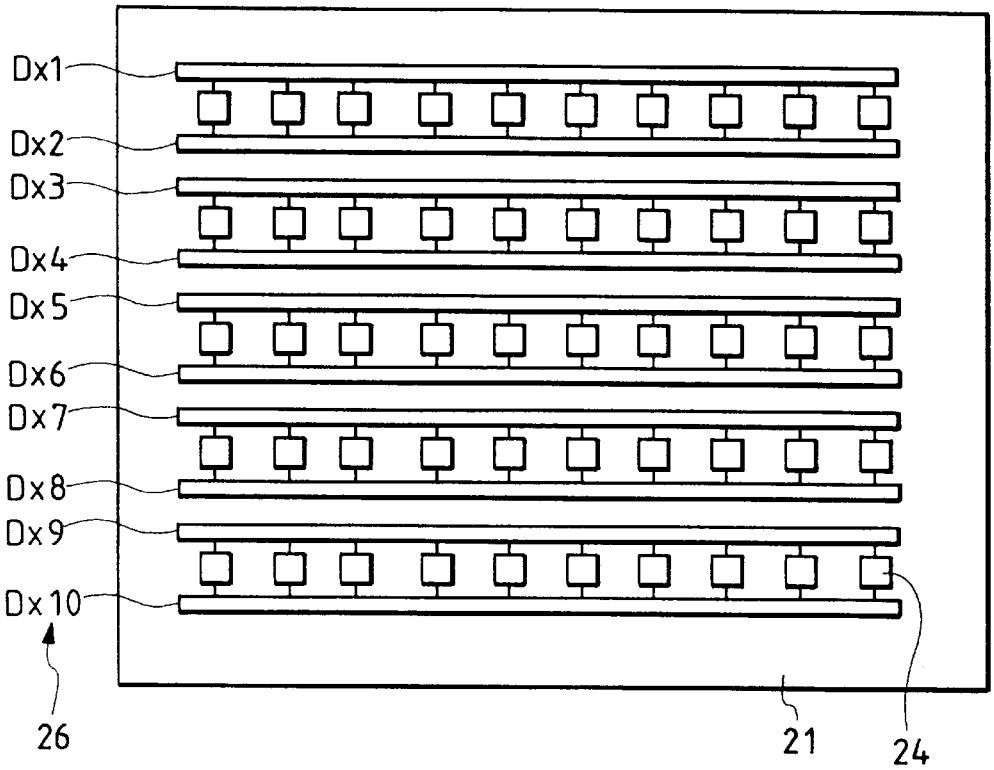
FIG. 14 is a schematic diagram illustrating interconnections in a ladder form used in the electron source according to the present invention.

FIG. 14 is a schematic diagram illustrating an example of a ladder-type electron source according to the invention. In FIG. 14, reference numeral 21 denotes an electron source substrate, 24 denotes an electron emitting device, and 26 denotes interconnections Dx1 to Dx10 for connecting a plurality of electron emitting devices 24 in common. In the ladder-type electron source substrate, a plurality of electron emitting devices 24 are disposed on a substrate 21 in a line along the X-direction (this line is referred to as a device row), and a plurality of similar device rows are disposed on the substrate in parallel. Each device row can be driven independently by applying a driving voltage separately to a desired device row via a corresponding common interconnection. That is, a voltage greater than the electron emission threshold is applied to a device row which is desired to be activated, while a voltage less than the electron emission threshold is applied to the other device rows which should not be activated. Some of the row interconnections, for example Dx2 and Dx3, may be connected in common.

Figure 15:
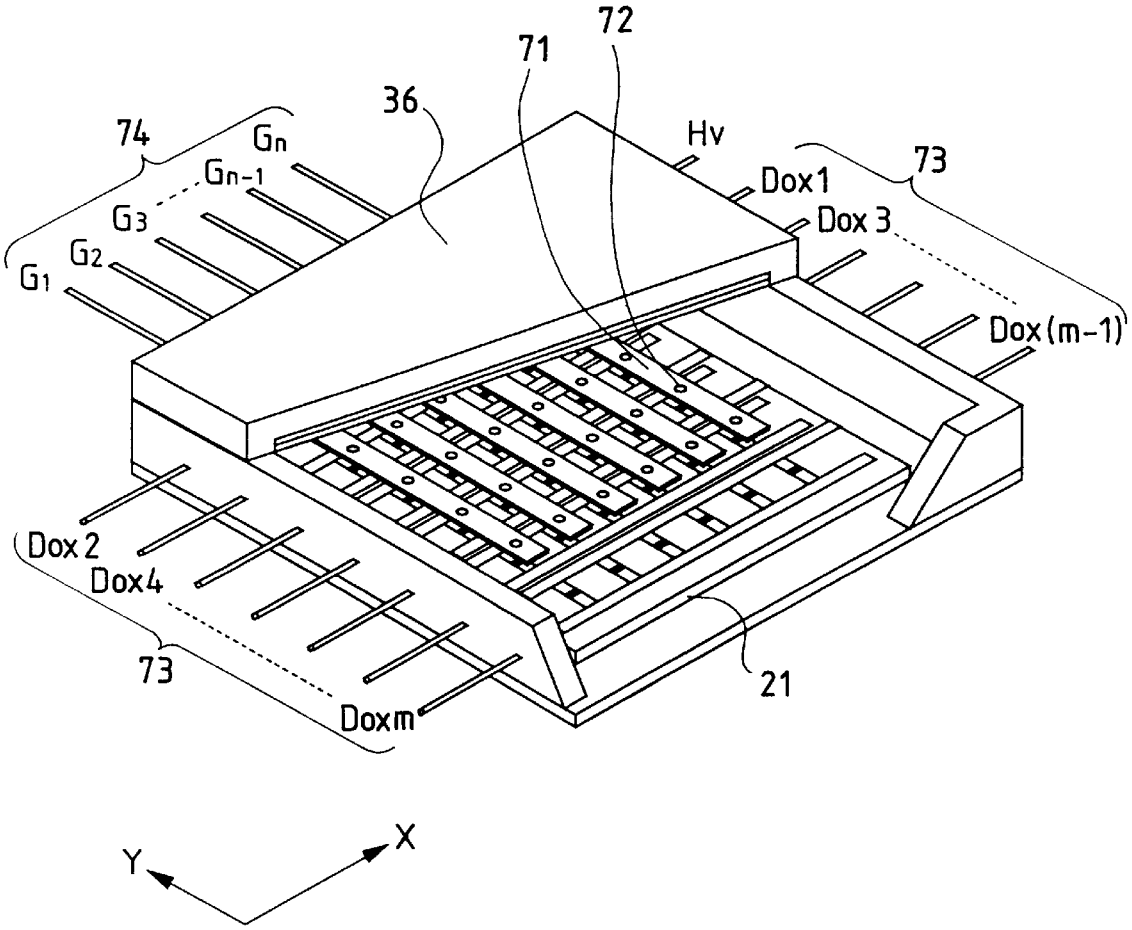
FIG. 15 is a schematic diagram illustrating the construction of an image forming apparatus using an electron source provided with interconnections in a ladder form.

FIG. 15 is a schematic diagram illustrating an example of the panel structure of an image forming apparatus provided with a ladder-type electron source. In FIG. 15, reference numeral 71 denotes a grid electrode, 72 denotes an opening through which electrons may pass, 73 denotes external terminals Dox1, Dox2, . . . , Doxm extending toward the outside of the case, and 74 denotes external terminals G1, G2, . . . , Gn connected to the grid electrodes 71 and extending toward the outside. In FIG. 15, similar members to those in FIGS. 9 and 14 are denoted by similar reference numerals. The image forming apparatus shown in FIG. 15 differs from the simple-matrix image forming apparatus described above with reference to FIG. 9 mainly in that the image forming apparatus shown in FIG. 15 has a grid electrode 71 disposed between the electron source substrate 21 and the face plate 36 while the image forming apparatus shown in FIG. 9 has no such a grid electrode. The grid electrode 71 is used to modulate the electron beam emitted by the surface conduction electron emitting devices. The grid electrode 71 includes stripe-shaped electrodes extending in a direction perpendicular to the device rows arranged in the ladder-form wherein the stripe-shaped electrodes have circular openings 72 each disposed at a location corresponding to each electron emitting device so that an electron beam may pass through these openings. The shape and the location of the grid is not limited to that shown in FIG. 15. For example, many openings may be disposed in a mesh form. Furthermore, openings may also be provided at locations in the vicinities of or in peripherals of surface conduction electron emitting devices.

The terminals 73 extending outward from the case and the grid terminals 74 extending outward from the case are electrically connected to a control circuit (not shown).

In this image forming apparatus, one line of image modulation signal is applied to the respective columns of the grid electrode in synchronization with the operation of driving (scanning) electron emitting devices row to row thereby controlling the irradiation of the electron beam to the phosphor and thus displaying an image line to line.

The image forming apparatus according to the present invention can be applied not only to a television system, but also to other display systems such as a video conference system, a display for a computer system, etc. Furthermore, the image forming apparatus according to the present invention can be coupled with a photosensitive drum and other elements so as to form an optical printer.

EXAMPLES

Referring to specific examples, the present invention will be described in further detail below. However, the present invention is not limited to these specific examples, and various modifications, changes, and substitutions are possible without departing from the spirit and scope of the invention.

Example 1

A specific example of a surface conduction electron emitting device according to the first embodiment of the invention will be described below. In this example, the conductive thin film is composed of fine particles of an alloy including Pd as a main constituent metallic element and also including Zr as a metallic element to constitute the low work function material layer.

The electron emitting device in this example has the same structure as that shown in FIGS. 2A and 2B. The method of producing the device of the present example will be described below with reference to FIGS. 3A to 3C.

Step (a)

A quartz substrate was employed as the substrate 1. The quartz substrate was cleaned well with a cleaning agent, water, and organic solvent. A photoresist (RD-2000N-41: available from Hitachi Chemical Co., Ltd.) was coated on the quartz substrate using a spinner, and then pre-baked at 80° C. for 20 min. The photoresist was exposed to light via a photomask having a pattern corresponding to the electrode shape with width W1=300 μm and spacing L1=2 μm. The photoresist was then developed in a developer so as to form openings corresponding to the electrode shape in the photoresist. Furthermore, the photoresist was post-baked at 120° C. for 20 min. thereby forming a resist pattern.

Step (b)

A 100-nm Ni film was deposited by vacuum evaporation on the substrate on which the resist pattern had been formed in the previous step. The resist pattern was then removed using an organic solvent so as to form device electrodes 2 and 3 (FIG. 3A).

Step (c)

A 50-nm Cr film was then deposited by vacuum evaporation. A photoresist (AZ-1370: available from Hoechst Corporation) was coated thereon, and openings corresponding to the shape of a conductive thin film which will be described later were formed in the photoresist using a common photolithography technique. Thus, a resist pattern was obtained.

Then wet etching was performed so as to remove the Cr film exposed via the openings. The photoresist was then removed using an organic solvent. Thus, a Cr pattern was obtained.

Step (d)

Sputtering was performed using a Pd-5 atomic % Zr alloy as a target at an argon gas pressure of 130 Pa with a sputtering voltage of 2 kV so as to form a fine alloy particle film having an average thickness of 30 nm.

The Cr pattern was then removed by means of wet etching so as to lift off unnecessary portions of the fine alloy particle film thereby obtaining the conductive thin film 4 having a desired shape (FIG. 3B).

Step (e)

The device obtained via the above process steps was placed in the vacuum processing apparatus shown in FIG. 6, and the energization forming process was performed on the device so as to form an electron emitting region. In the above energization forming process, the vacuum chamber 11 was evacuated to a pressure of about $1\times10^{-3}$ Pa using the evacuation pump system 12 including an adsorption pump and an ion pump. Triangular pulses were applied to the device while gradually increasing the pulse height so as to forming the electron emitting region 5. The width T1 and interval T2 of the pulses were set to T1=1 msec and T2=10 msec. The resistance was monitored in each pulse interval by measuring a current which occurs when applying a square pulse having a height of 0.1 V. When the resistance had reached 1 MΩ, the energization forming process was stopped (FIG. 3C).

Step (f)

Then the activation process was performed as follows. $ZrCl_4$ was introduced into the vacuum chamber. The flow rate was adjusted so that the pressure became about $5\times10^{-1}$ Pa. In this ambient, rectangular pulses with a width of 100 μsec and a height of 15 V were applied at 10 msec intervals to the device for 30 min.

After the above activation process, increases were observed in both the device current If and the emission current Ie.

The vacuum chamber and the device placed therein were heated at 150° C. while pumping the vacuum chamber. Then the vacuum chamber and the device were cooled down to room temperature. When the temperatures of the vacuum chamber and the device had dropped down to room temperature, the pressure in the vacuum chamber was $1.3\times10^{-4}$ Pa.

Comparative Example 1

For the purpose of comparison, a surface conduction electron emitting device was also fabricated in the same manner as the above Example 1 except that in the process of forming a conductive thin film in Step (d) Pd was employed as the sputtering target so as to form a 30 nm thick film consisting of fine Pd particles.

The devices obtained in Example 1 and Comparative Example 1 were evaluated in terms of the electron emission characteristics and the change in the characteristics with time (due to aging). In the evaluation, a voltage in the form of pulse having a height of 15V and a width T1 of 100 μsec was applied to the device at intervals of 10 msec. The devices were placed at a location 5 mm apart from the anode electrode and 1 kV was applied between the devices and the anode.

The emission current Ie, device current If, and electron emission efficiency were measured for both devices at the start of the test and also at the end of the test after a certain time period had passed. The results are shown in Table 2.

TABLE 2

| | At the start | | | After aging | | |
|---|---|---|---|---|---|---|
| | Ie (μA) | If (mA) | η (%) | Ie (μA) | If (mA) | η (%) |
| Example 1 | 4.0 | 2.0 | 0.20 | 3.2 | 1.7 | 0.19 |
| Comp. Ex. 1 | 3.8 | 2.0 | 0.19 | 2.4 | 1.6 | 0.15 |

To evaluate the recoverability, the device of Example 1 which had been subjected to the above aging were further subjected to the following process.

That is, pulses having a height of 11 V were applied to the device for 5 min. without applying any voltage to the anode. After the above process, the electron emission characteristics of the device were measured again. The results were as follows: emission current Ie=3.7 μA, device current If=1.9 mA, and electron emission efficiency η=0.19% in which recovery in the electron emission characteristics is observed.

The recovery mechanism is probably as follows: Some portions of the electron emitting device encounter a severe condition of a large current density during a normal operation and the low work function material layer in such portions is lost so quickly that supply of the element from the inner portion to the low work function material layer at the surface is not sufficient. If a voltage lower than the normal operating voltage is applied to the device, the loss of the low work function material is suppressed while maintaining the supply of the element, and thus the low work function material layer is recovered.

Example 2

A surface conduction electron emitting device was fabricated in the same manner as in Example 1 except that in the process of forming a conductive thin film in Step (d), Pd-5 atomic % Ti alloy was employed as the sputtering target and that in Step (f) for activation, $TiCl_4$ gas was employed.

Comparative Example 2

For the purpose of comparison, a surface conduction electron emitting device was also fabricated in the same manner as the above Example 2 except that in Step (d) of the process for forming a conductive thin film, Pt was employed as the sputtering target so as to form a film consisting of fine Pt particles.

The devices obtained in Example 2 and Comparative Example 2 were evaluated in terms of the electron emission characteristics and the change in the characteristics with time (due to aging) in a similar manner to Example 1 and Comparative Example 1. The results are shown in Table 3.

TABLE 3

| | At the start | | | After aging | | |
|---|---|---|---|---|---|---|
| | Ie (μA) | If (mA) | η (%) | Ie (μA) | If (mA) | η (%) |
| Example 2 | 3.0 | 1.5 | 0.20 | 2.8 | 1.5 | 0.19 |
| Comp. Ex. 2 | 2.8 | 1.6 | 0.18 | 2.0 | 1.3 | 0.15 |

Example 3

A surface conduction electron emitting device was fabricated in the same manner as in Example 1 except that in Step (d) of the process for forming a conductive thin film, Ni-7 atomic % Ti-4 atomic % Ir alloy was employed as the sputtering target so as to form a film consisting of fine particles of the above alloy and that in Step (f) for activation, a mixture of $TiCl_4$ gas and $IrCl_4$ was employed.

Comparative Example 3

For the purpose of comparison, a surface conduction electron emitting device was also fabricated in the same manner as the above Example 3 except that in Step (d) of the process for forming a conductive thin film, Ni was employed as the sputtering target so as to form a film consisting of fine Ni particles.

The devices obtained in Example 3 and Comparative Example 3 were evaluated in terms of the electron emission characteristics and the change in the characteristics with time (due to aging) in a similar manner to Example 1 and Comparative Example 1. The results are shown in Table 4.

TABLE 4

| | At the start | | | After aging | | |
|---|---|---|---|---|---|---|
| | Ie (μA) | If (mA) | η (%) | Ie (μA) | If (mA) | η (%) |
| Example 3 | 3.0 | 1.6 | 0.19 | 2.8 | 1.5 | 0.19 |
| Comp. Ex. 3 | 2.8 | 1.6 | 0.18 | 2.0 | 1.3 | 0.15 |

Although the work function of Ir is not so low compared to that of Ni, Ir has a high melting point and a small ionic radius. Therefore, Ir diffuses together with Ti toward the surface of the electron emitting region and precipitates at the surface. This can contribute to improvement in stability.

Example 4

Device electrodes were formed on a quartz substrate according to the same procedure Step (a) to Step (c) employed in Example 1. Then a Cr film having a pattern corresponding to the conductive thin film was formed thereon. After that, the following process was performed:

Step (d)

An organic Zr compound solution (ethanol solution of zirconium 2,4-pentadionale) was coated and heated at 400° C. for 15 min in the atmospheric ambient. An organic Pd compound solution (ccp4230, Okuno Pharmaceutical Co. Ltd.) was coated and then heated at 300° C. for 12 min in an atmospheric ambient.

Step (e)

The Cr pattern was then removed by meas of wet etching so as to lift off unnecessary portions of the above coated film thereby obtaining a conductive thin film 4 having a desired shape. Subsequently, heat treatment was performed in an ambient of flowing $H_2$ gas so that the conductive thin film was subjected to reduction process. At this stage, the conductive thin film had been converted into a form of a mixture of fine particles of Pd and Zr.

Then the forming process and the activation process were performed in the same manner as in Steps (e) and (f) in Example 1.

The device was evaluated in terms of the electron emission characteristics and the change in the characteristics with time. The result was very similar to that of Example 1.

Examples 5–9 and Comparative Examples 5 and 6

In these examples, the device structure was similar to that shown in FIGS. 2A and 2B. Device electrodes 2 and 3 were formed on a quartz substrate 1 so that the spacing L between the electrodes was 3 μm the length W of the electrodes was 500 μm, and the thickness d was 100 nm.

A thin Au—Cs film in which an electron emitting region was to be formed in a later process step was then deposited using the electron beam evaporation technique. In this process, the Au—Cs was evaporated through a metal mask so that the resultant Au—Cs film extended from one electrode 2 to the other electrode 3 as shown in FIGS. 2A and 2B. The thickness d of the Au—Cs film was adjusted to 10 nm. The composition of the Au—Cs film was adjusted by controlling the amounts of evaporation source materials. The determination of the composition was made using Auger electron spectroscopy.

The device obtained via the above process was placed on the evaluation apparatus in the vacuum chamber. When the device was transported from the vacuum evaporator into the vacuum chamber for evaluation, the device was maintained in a vacuum or inert gas ambient so that the device was not exposed to oxygen, water, carbon dioxide, and similar contaminant gases.

In the evaluation, the inside of the vacuum chamber was maintained at a pressure of about $1.3\times10^{-4}$ Pa. Before the evaluation, an electron emitting region 5 was formed as follows.

A voltage was applied between the electrodes 2 and 3 so that the thin Au—Cs film (the conductive thin film) was subjected to the energization forming process thereby forming an electron emitting region 5 in the thin Au—Cs film.

A plurality of devices were fabricated so that the Cs content of the Au—Cs mixture varies from device to device, and electron emission efficiency η was measured for these devices. If the Cs content was greater than 8 atomic %, degradation was observed in the electron emission efficiency after aging tests. Therefore, the Cs content was limited to the range less than 7 atomic % so as to obtain a good electron emission efficiency. The results are shown in Table 5.

TABLE 5

| | Cs content (atomic %) | η(%) |
|---|---|---|
| Comp. Ex. 5 | 0 | 0.010 |
| Comp. Ex. 6 | 2 | 0.010 |
| Example 5 | 3 | 0.012 |
| Example 6 | 4 | 0.014 |
| Example 7 | 5 | 0.015 |
| Example 8 | 6 | 0.017 |
| Example 9 | 7 | 0.018 |

The conductive thin film was observed for the devices obtained in Examples 5–9 as well as Example 1. The observation revealed that the conductive thin film consisted of fine particles having a size of about 10 nm in all devices. The fine particles were further observed using a high-resolution transmission electron microscope. In the device obtained in Comparative Example 1, a contrast pattern corresponding to an Au single crystal was observed. On the other hand, in the case of Examples 5–9, a different contrast pattern was observed.

If the composition is taken into account, the observed pattern suggests that the fine particles of Examples 5–9 includes a phase of Au having a face-centered cubic lattice structure in which a phase of $Au_5Cs$ having a hexagonal lattice structure precipitates. Since $Au_5Cs$ is incorporated in the stable phase of Au, the stability of the phase of $Au_5Cs$ is ensured. Cs moves gradually toward the surface of fine particles via thermal diffusion or the like. As a result, the work function of the fine particles is lowered and the electron emission efficiency is improved.

If the content of Cs is too great, the phase of $Au_5Cs$ appears directly at the surface of fine particles and reacts with residual $H_2O$ or $CO_2$. As a result the electron emission efficiency decreases with time.

Examples 10–14 and Comparative Example 7

Surface conduction electron emitting devices were fabricated in the same manner as the previous examples except that an Au—Ba mixture was employed as the material of the conductive thin film, and the electron emission efficiency η was evaluated. If the Ba content was greater than 9 atomic %, degradation was observed in the electron emission efficiency after aging tests. Therefore, the Ba content was limited to the range less than 8 atomic % so as to obtain a good electron emission efficiency. The results are shown in Table 6.

TABLE 6

| | Ba content (atomic %) | η(%) |
|---|---|---|
| Example 7 | 2 | 0.010 |
| Example 10 | 3 | 0.012 |
| Example 11 | 4 | 0.013 |
| Example 12 | 5 | 0.014 |
| Example 13 | 7 | 0.016 |
| Example 14 | 8 | 0.018 |

The devices obtained in Examples 10–14 were observed using the transmission electron microscope in a similar manner to the previous Examples. The observation showed that the fine particles in the conductive thin film included Au and a phase of $As_5Ba$ incorporated in Au.

Examples 15–20 and Comparative Example 8

Surface conduction electron emitting devices were fabricated in the same manner as the previous examples except that an Au—Sr mixture was employed as the material of the conductive thin film, and the electron emission efficiency η was evaluated. If the Sr content was greater than 9 atomic %, degradation was observed in the electron emission efficiency after aging tests. Therefore, the Sr content was limited to the range less than 8 atomic % so as to obtain a good electron emission efficiency. The results are shown in Table 7.

TABLE 7

| | Sr content (atomic %) | η(%) |
|---|---|---|
| Comp. Ex. 8 | 2 | 0.010 |
| Example 15 | 3 | 0.012 |
| Example 16 | 4 | 0.013 |
| Example 17 | 5 | 0.015 |
| Example 18 | 6 | 0.016 |
| Example 19 | 7 | 0.017 |
| Example 20 | 8 | 0.018 |

Examples 21–26 and Comparative Examples 9 and 10

Figure 16:
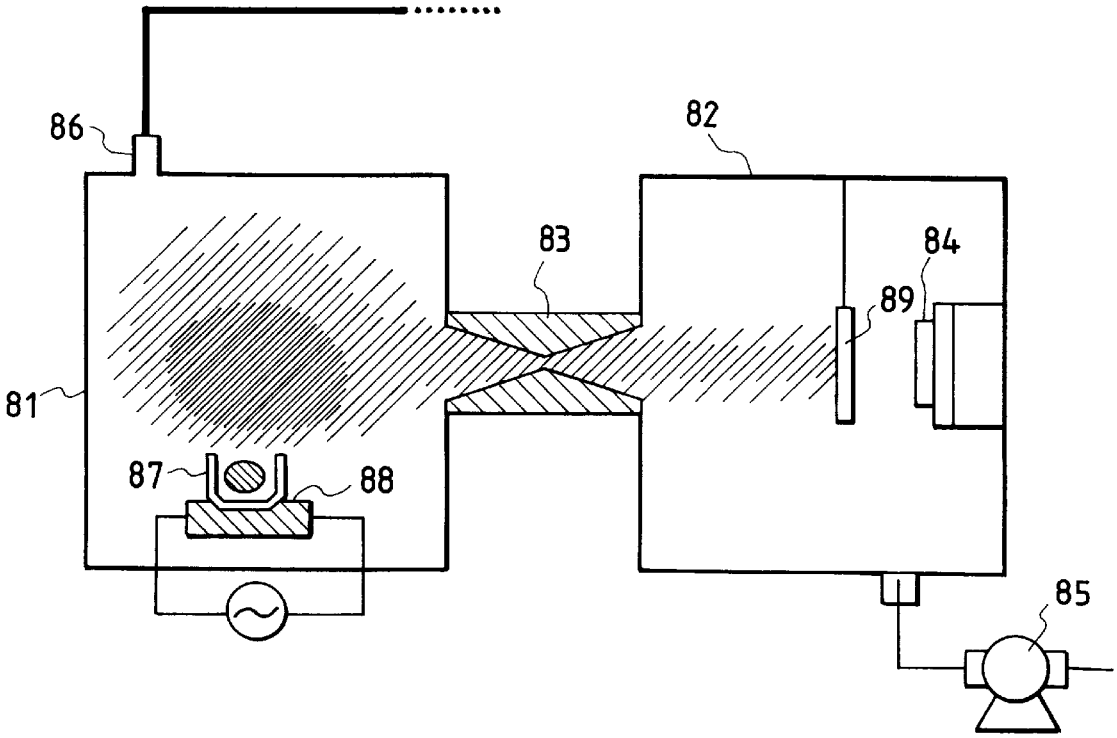
FIG. 16 is a schematic diagram illustrating an apparatus used to deposit a fine particle film of a surface conduction electron emitting device according to the present invention.

Surface conduction electron emitting devices were fabricated in the same manner as the previous examples except that a Pt—Sr mixture was employed as the material of the conductive thin film, and the electron emission efficiency η was evaluated. In the fabrication process, a Pt Sr film was deposited by means of evaporation in a gas ambient. The film deposition was performed using the apparatus shown in FIG. 16. The film deposition apparatus includes a particle generation chamber 81, particle deposition chamber 82, and a nozzle 83 disposed between the these chambers. Reference numeral 84 denotes a location where a device is set in the process. The film deposition apparatus was evacuated by an evacuation pump 85 to a pressure $6.7\times10^{-5}$ Pa. Then Ar gas was introduced into the particle generation chamber via a gas inlet 86. The flow rate of the Ar gas was controlled so that the pressure in the particle generation chamber became 6.7 Pa. In this situation, the pressure in the particle deposition chamber was $1.3\times10^{-2}$ Pa. The diameter of the nozzle was 5 mm, and the distance between the nozzle and the sample (device) was 150 mm. A source material for the electron emission region was placed in a crucible 87 around which a tungsten heater 88 was disposed. The source material of the electron emitting region was heated by the heater 88, so that particles of the source material were effused via the nozzle toward the device and deposited thereon. The thickness of the particle film was adjusted by opening and closing a shutter 89. If the Sr content was greater than 9 atomic %, degradation was observed in the electron emission efficiency after aging tests. Therefore, the Sr content was limited to the range less than 8 atomic % so as to obtain a good electron emission efficiency. After the deposition of the particle film, the electron emitting region was formed in a similar manner to the previous Examples, the device was evaluated also in a similar manner to the previous Examples. The result is shown in Table 8.

TABLE 8

| | Sr content (atomic %) | η(%) |
|---|---|---|
| Comp. Ex. 9 | 0 | 0.050 |
| Comp. Ex. 10 | 2 | 0.050 |
| Example 21 | 3 | 0.058 |
| Example 22 | 4 | 0.062 |
| Example 23 | 5 | 0.069 |

TABLE 8-continued

| | Sr content (atomic %) | η(%) |
|---|---|---|
| Example 24 | 6 | 0.071 |
| Example 25 | 7 | 0.074 |
| Example 26 | 8 | 0.078 |

The observation using the transmission electron microscope showed that particles of the conductive thin film had a structure consisting of a main constituent of Pt and a $Pt_5Sr$ phase incorporated in Pt.

Examples 27–32 and Comparative Example 11

Surface conduction electron emitting devices were fabricated in the same manner as the previous Examples 21–26 and the Comparative Examples 9 and 10 except that a Pt—Ba mixture was employed as the material of the conductive thin film. For the same reason as in the previous examples, the Ba content was limited to the range less than 8 atomic % so that a good electron emission efficiency was achieved. The result is shown in Table 9.

TABLE 9

| | Ba content (atomic %) | η(%) |
|---|---|---|
| Comp. Ex. 11 | 2 | 0.050 |
| Example 27 | 3 | 0.057 |
| Example 28 | 4 | 0.063 |
| Example 29 | 5 | 0.069 |
| Example 30 | 6 | 0.072 |
| Example 31 | 7 | 0.075 |
| Example 32 | 8 | 0.077 |

The observation using the transmission electron microscope showed that particles of the conductive thin film had a structure consisting of a main constituent of Pt and a $Pt_5Ba$ phase incorporated in Pt.

Examples 33–38 and Comparative Examples 12 and 13

As in the previous Examples and Comparative Examples, after forming device electrodes 2 and 3 on a quartz substrate 1, a conductive thin film 4 consisting of palladium monoxide particles was formed between the device electrodes as follows:

A solution of an organic palladium compound (available from Okuno Pharmaceutical Co., Ltd.) was coated on the substrate using a spinner and then heated at 300° C. for 10 min. so that a fine particle film 44 consisting of palladium monoxide (PdO) particles (with an average diameter of 7 nm) was formed. The resultant fine particle film showed a sheet resistance of $5\times10^4$ Ω/□.

Then a suspension obtained by dispersing dimethoxybarium ($Ba(OCH_3)_2$) into ethanol was spin-coated on the fine particle film, and was dried. The above spin coating and drying process was repeated a few times.

For comparison, devices having no dimethoxybarium layer were also fabricated.

The device obtained via the above process was placed on the evaluation apparatus in the vacuum chamber. The vacuum chamber was evacuated down to a pressure of about $1.3\times10^{-4}$ Pa. A voltage was applied between the electrodes 2 and 3 so that the conductive thin film was subjected to the energization forming process thereby forming an electron emitting region 5 in the conductive thin film. FIG. 4A illustrates the voltage waveform used in the above forming process. In FIG. 4A, T1 and T2 denote the pulse width and pulse interval, respectively. In these Examples, T1 was set to 1 msec and T2 to 10 msec. The pulse height of the triangular waveform (which gives the peak voltage in the forming process) was set to 5 V. With the above applied pulse voltage, the forming process was performed in a vacuum with a pressure of about $1.3\times10^{-4}$ Pa for 60 sec. The electron emitting region 15 obtained via the above process had a structure in which fine particles with an average diameter of 3 nm whose main constituent was palladium were dispersed.

The device was then placed into an electric furnace and heated at 300° C. in an ambient of flowing Ar-2% $H_2$ gas so that the palladium monoxide was reduced into metal. The composition of the film was analyzed in a similar manner to the previous Examples. In the above process, the Ba content was adjusted by properly selecting the number of repeated processes of coating the suspension of dimethoxybarium. The evaluated electron emission characteristics of the devices are shown in Table 10.

TABLE 10

| | Ba content (atomic %) | η(%) |
|---|---|---|
| Comp. Ex. 13 | 0 | 0.050 |
| Comp. Ex. 14 | 2 | 0.050 |
| Example 33 | 3 | 0.055 |
| Example 34 | 4 | 0.059 |
| Example 35 | 5 | 0.062 |
| Example 36 | 6 | 0.066 |
| Example 37 | 7 | 0.072 |
| Example 38 | 8 | 0.076 |

The observation using the transmission electron microscope showed that particles of the electron emitting region had a structure consisting of a main constituent of Pd and a $Pd_5Ba$ phase incorporated in Pd.

Example 39

An example of an electron source on which a plurality of surface conduction electron emitting devices described in the above Examples are disposed, and also an example of an image forming apparatus constructed with such an electron source will be described below. In the following description, it is assumed that the surface conduction electron emitting devices are fabricated according to the process shown in Example 1. However, the electron source and the image forming apparatus of the present invention are not limited to that. Any surface conduction electron emitting device may also be employed as long as it is fabricated according to the present invention.

In this example, the electron source includes a plurality of surface conduction electron emitting devices shown in FIGS. 2A and 2B, which are arranged into a simple matrix form (20 rows×60 columns including three colors) as shown in FIG. 8. Using this electron source, an image forming apparatus such as that shown in FIG. 9 was produced.

Figure 17:
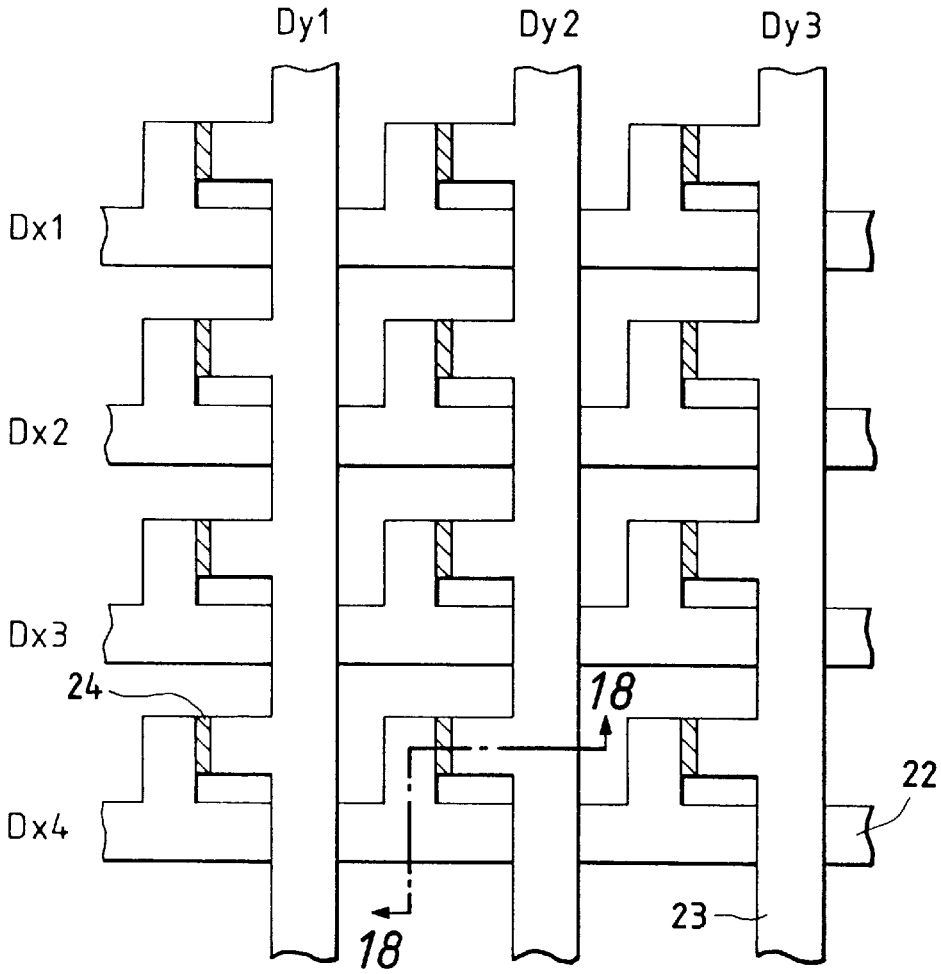
FIG. 17 is a plan view partially illustrating the structure of the electron source provided with interconnections in a matrix form.
Figure 18:
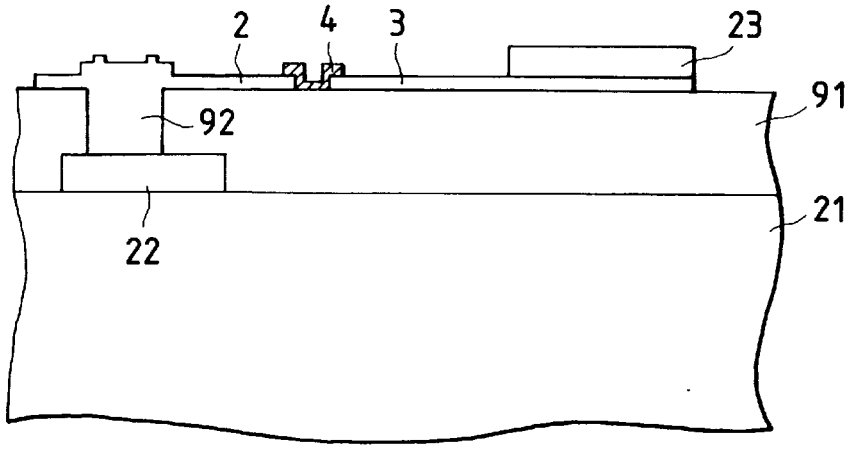
FIG. 18 is a cross-sectional view taken along the line 18—18 of FIG. 17.
Figure 19A:
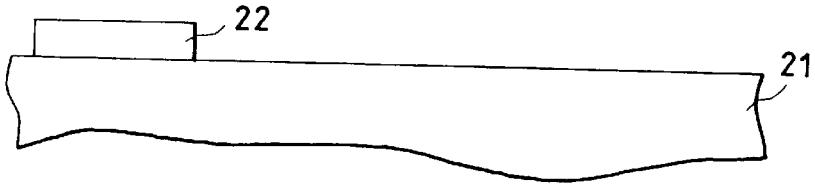
FIGS. 19A to 19H are schematic diagrams illustrating the production flow of the electron source provided with the interconnections in the matrix form.
Figure 19B:
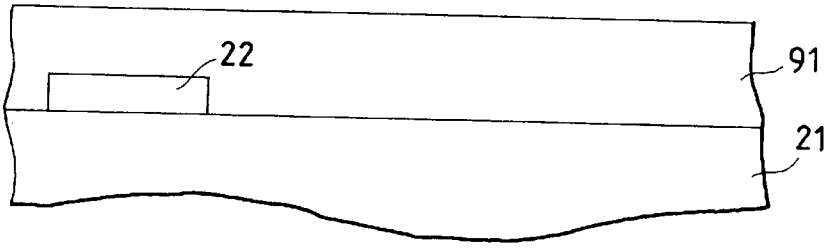
Figure 19C:
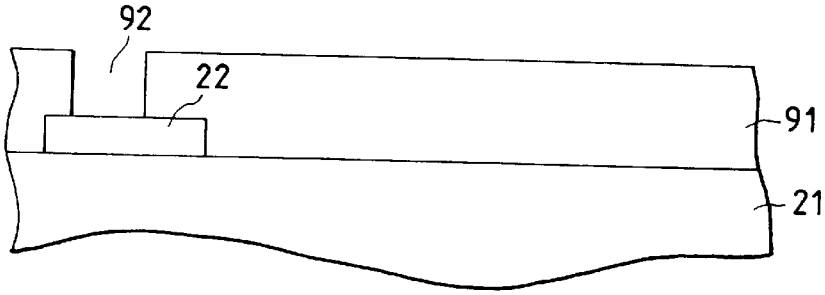
Figure 19D:
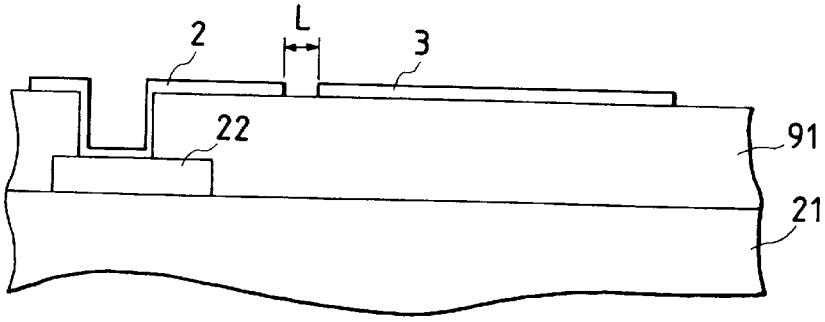
Figure 19E:
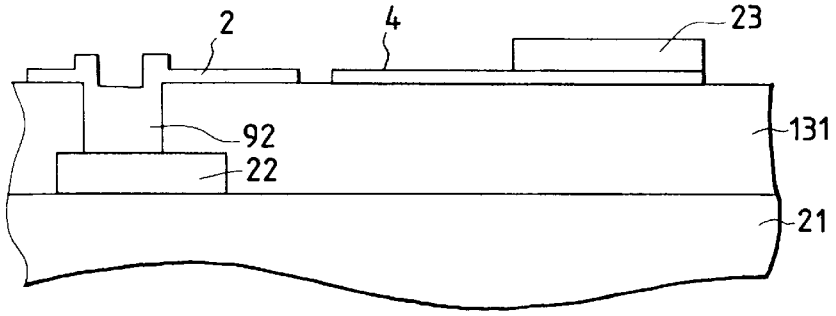
Figure 19F:
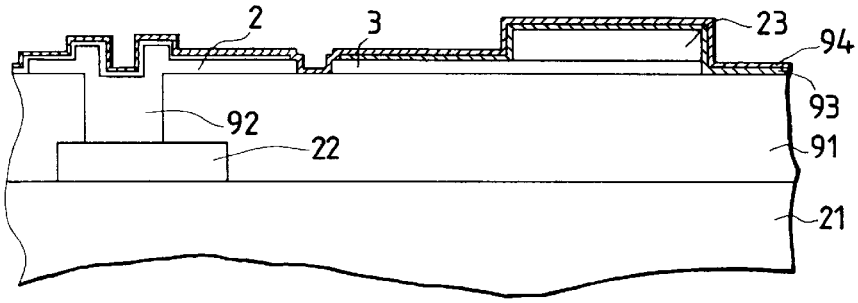
Figure 19G:
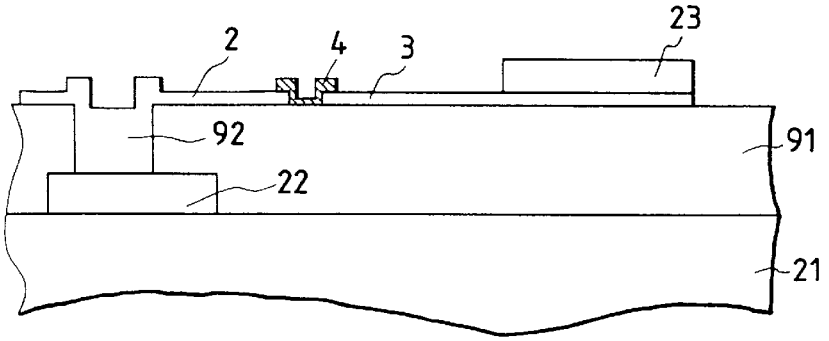
Figure 19H:
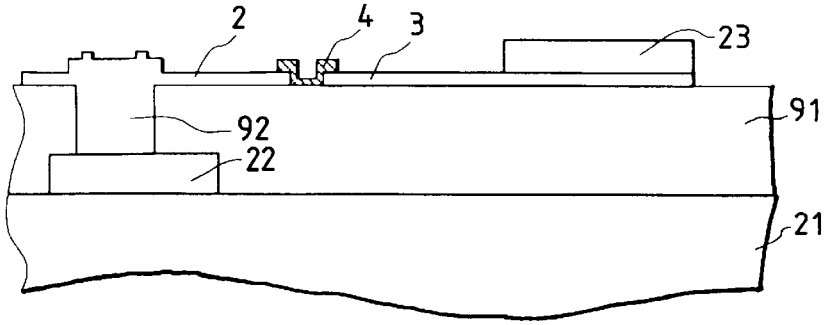

FIG. 17 is a plan view showing a part of the electron source. FIG. 18 is a cross-section view taken along the line 18—18 of FIG. 17. In these FIGS. 17 and 18, similar members are denoted by similar reference numerals, wherein reference numeral 21 denotes a substrate, 22 denotes interconnection along the X-direction (also referred to as a lower interconnection), 23 denotes an interconnection along the Y-direction (also referred to as an upper interconnection), 4 denotes a conductive thin film, 2 and 3 denote device electrodes, 91 denotes an interlayer insulating film, and 92 denotes a contact hole for electrically connecting the device electrode 2 and the lower interconnection 22. The process flow of the electron source employed in this example will be described below. In the following description, Steps (a)–(h) correspond to FIGS. 19A–19H, respectively.

Step (a): A 0.5 μm thick silicon dioxide film was formed by means of sputtering on a soda lime glass substrate 21 which had been cleaned. Then a 5 nm thick Cr film and a 600 nm thick Au film were deposited successively thereon by means of vacuum evaporation. A photoresist (AZ1370, Hoechst) was then spin-coated and backed. Exposure and development were performed so as form a resist pattern corresponding to the lower interconnection 27. The Au/Cr film was wet-etched using the resist pattern as a mask thereby forming a lower interconnection 22 having a desired shape.

Step (b): Then a 1.0 μm thick silicon dioxide film serving as the interlayer insulating film 91 was deposited by means of sputtering.

Step (c): A photoresist having a contact-hole pattern was formed on the silicon dioxide film obtained in Step (b). The interlayer insulating film 91 was etched using the photoresist as a mask thereby forming a contact hole 92. The etching was performed by means of RIE (reactive ion etching) with $CF_4$ and $H_2$ gas.

Step (d): A photoresist (RD-2000N-41, Hitachi-kasei Co.) was coated and a pattern corresponding to the gap L between the device electrodes 2 and 3 was formed in the photoresist. Then, a 5 nm thick Ti film and a 100 nm Ni film were successively evaporated. The photoresist was removed using an organic solvent so that the Ni/Ti film was lifted off thereby forming the device electrodes 2 and 3 having a width W1 of 300 μm and spaced 3.0 μm apart.

Step (e): A photoresist pattern corresponding to the upper interconnection 23 was formed on the device electrodes 2 and 3. A 5 nm thick Ti film and a 500 nm thick Au film were evaporated successively on the photoresist pattern. Then unnecessary portions of these films were removed by means of the lift-off technique thereby forming an upper interconnection 23.

Step (f): A 10 nm thick Cr film 93 was deposited by means of vacuum evaporation and then was patterned. A film consisting of Pd-5 atomic % Zr alloy particles was deposited thereon in a similar manner to Step (d) in Example 1.

Step (g): The Cr film 93 was etched using an etchant so that the Pd-5 atomic % Zr alloy particle film was lifted off thereby forming a conductive thin film 4 having a desired shape. The thickness of the conductive thin film 4 was 30 nm.

Step (h): A photoresist was coated on the entire surface, a contact-hole pattern was formed in the photoresist by means of exposure and development. A 5 nm thick Ti film and a 500 nm thick Au were successively deposited by means of vacuum evaporation. Then unnecessary portions were removed by means of the lift-off technique thereby forming a contact metal embedded in the contact hole 92.

Thus, the lower interconnection 22, interlayer insulating film 91, upper interconnection 23, device electrodes 2 and 3, and conductive thin film 4 had been formed on the substrate 1. An electron source obtained in this way, which had not been subjected to a forming process, was used to produce an image forming apparatus as described in detail below with reference to FIGS. 9, 10A, and 10B.

The electron source substrate 1 which had not been subjected to the forming process yet was placed on a rear plate 81 and fixed thereto. A face plate 36 (consisting of a glass substrate 33, and a fluorescent film 34 serving as an image-forming member and a metal back 35 disposed on the inner face of the glass substrate 33) was disposed 5 mm apart from the substrate 21 via a supporting frame 32. Connecting portions between the face plate 36, supporting frame 32, and rear plate 31 were coated with frit glass and baked at 400° C. for 10 min in the atmosphere thereby sealing these members. The fixing of the rear plate 31 to the substrate 1 was also performed with frit glass.

The fluorescent film 34 serving as the image-forming member was formed with a stripe-shaped phosphor (refer to FIG. 10A) to realize the capability of representing a color image. First black stripes were formed, and then each color phosphor 92 was coated between adjacent black stripes by means of slurry technique thereby forming the fluorescent film 34. The black stripes were formed using a widely-used material including graphite as the main constituent.

A metal back 35 was disposed on the inner side of the fluorescent film 34. The metal back 35 was formed in such a manner that after forming the fluorescent film 34, the inner surface of the fluorescent film was smoothed (this smoothing process is usually called filming), and then Al was deposited on the fluorescent film by means of evaporation. If it is desired to further increase the conductivity of the fluorescent film 34, the face plate 33 may be provided with a transparent electrode on the outer side of the fluorescent film 34. However, in the present example, since the metal back was able to provide a high enough conductivity, no transparent electrode was disposed.

When the above components were combined and sealed into a unit, the components were positioned precisely so that phosphors of respective colors 92 were disposed at correct locations corresponding to electron emitting devices 24.

After evacuating the inside of the envelope 37 obtained via the above process to a sufficiently low pressure, the energization forming process was performed by applying a pulse voltage between the device electrodes 2 and 3 via the external terminals Dox1–Doxm and Doy1–Doyn thereby forming an electron emitting region 5.

After that, as in Example 1, $ZrCl_4$ was introduced into the envelope and the activation process was performed.

Subsequently, the stabilization process was performed as follows. The inside of the envelope 37 was evacuated down to a pressure of $4.2\times10^{-4}$ Pa while heating it at 120° C. Then the exhaust pipe (not shown) was sealed by heating it with a gas burner thereby sealing the envelope 37. Finally, gettering was performed by means of RF heating so that the inside of the sealed envelope 37 was maintained at a low pressure.

The resultant image forming apparatus obtained via the above production process showed good performance in displaying an image wherein the image was formed by applying a scanning signal and a modulation signal generated by signal generating means (not shown) to the respective electron emitting devices 24 via the external terminals Dox1–Doxm and Doy1–Doyn thereby emitting electrons which were then accelerated by a high voltage of the order of a few kV applied to the back-metal 35 via the high-voltage terminal Hv so that the accelerated electrons strike the fluorescent film 34 thereby exciting it and thus light is emitted from the fluorescent film 34.

Example 40

Figure 20:
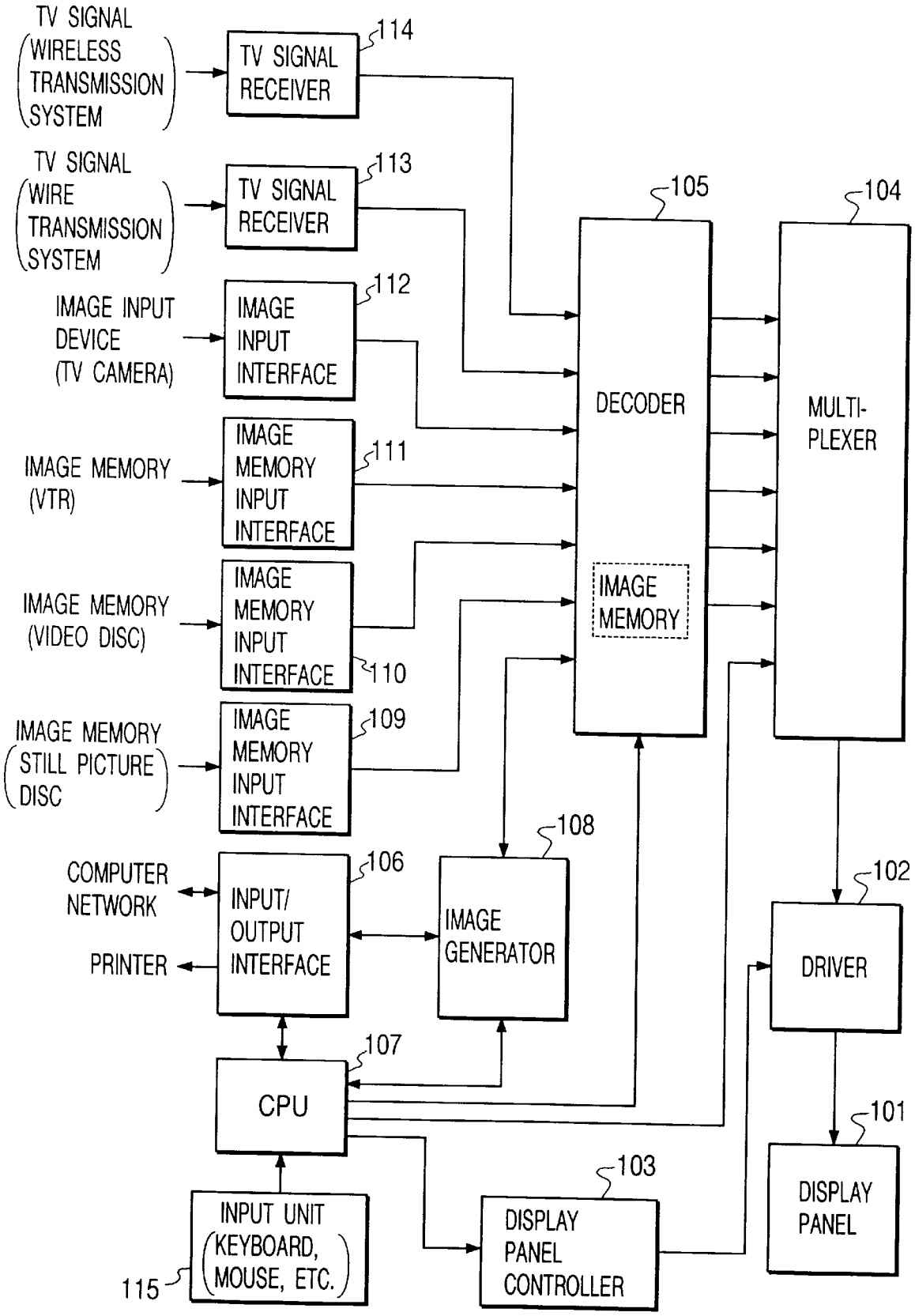
FIG. 20 is a block diagram illustrating a system including the image forming apparatus of the present invention, for processing and displaying various types of input image signals.

FIG. 20 illustrates an example of a display device in which the image forming apparatus 101 obtained in Example 30 is employed to display image information supplied from various image information sources such as television broadcasting.

In FIG. 20, reference numeral 101 denotes an image forming apparatus, 102 denotes a driving circuit for driving the image forming apparatus, 103 denotes a controller for controlling the image forming apparatus, 104 denotes a multiplexer, 105 denotes a decoder, 106 denotes an input/output interface circuit, 107 denotes a CPU, 108 denotes an image generation circuit, 109, 110 and 111 denote an image memory interface circuit, 112 denotes an image input interface circuit, 113 and 114 denote a TV receiving circuit, and 115 denotes an input device.

Although this display device can also reproduce a signal including both image and audio information such as a TV signal, the circuits for dealing with the audio signal, such as those for receiving, extracting, reproducing, processing, and storing audio information, as well as other devices concerned with audio information such as a loudspeaker are not essential in the present invention and thus they are described here in further detail.

Each circuit concerned with an image signal will be described below.

The TV signal receiving circuit 114 is provided for receiving a TV image signal which is transmitted via a radio transmission medium or system such as a radio wave or a spatial optical communication system.

The TV signal is not limited to one according to a special standard and any type of TV signal such as an NTSC, PAL, or SECAM signal can be received. Furthermore, a TV signal consisting of a greater number of lines than those of the above standards, can also be received. Such TV signals include for example signals based on the MUSE standard and other high definition television standards. The image forming apparatus 101 of the invention is suitable for use in a large-sized and/or high-density image display device, and thus suitable for display such high-quality TV signals.

The TV signal received via the TV signal receiving circuit 114 is supplied to the decoder 105.

The TV signal receiving circuit 113 is for receiving a TV image signal which is transmitted via a cable transmission line such as a coaxial cable or an optical fiber. As in the TV signal receiving circuit 114, the TV signal to be received is not limited to a TV signal according to a special standard. The TV signal received via the TV signal receiving circuit 113 is also supplied to the decoder 105.

The image input interface circuit 112 is for inputting an image signal supplied from an image input device such as a TV camera or an image scanner. The obtained image signal is transferred to the decoder 105.

The image memory interface circuit 111 is for inputting an image signal recorded on a video tape recorder (hereafter referred to as a VTR). The obtained image signal is also transferred to the decoder 105.

The image memory interface circuit 110 is for inputting an image signal recorded on a video disk, and the obtained image signal is also transferred to the decoder 105.

The image memory interface circuit 109 is for inputting an image signal recorded on a still-image recording device such as a still image disk, and the obtained image signal is also transferred to the decoder 105.

The input/output interface circuit 106 is provided for connecting the display device to an external device such as a computer, a computer network, or an output device such as a printer. Via the input/output interface circuit 106, various data such as image data, character data, and graphics data are input and output. If desired, the input/output interface circuit 106 can also be used by the CPU 107 in the display device to input and output a control signal or numerical data from and to an external device.

The image generation circuit 108 generates image data to be displayed on the basis of image, character, or graphics information input from an external device via the input/output interface circuit 106 or image, character, or graphics information output from the CPU 107. The image generation circuit 108 has various circuits required to generate image data. They include: a writable memory for storing various data such as image, character, and graphics data; a read-only-memory for storing image patterns corresponding to character codes; and a processor for performing an image processing operation.

The image data to be displayed generated by the image generation circuit 108 is supplied to the decoder 105. However, if required, the image data can also be output to the external computer network or the printer via the input/output interface circuit 106.

The CPU 107 is concerned with the control of the display device, and also with the generation, selection, and edit of an image to be displayed.

For example, the CPU 107 outputs a control signal to the multiplexer 104, selects an image signal to be displayed on the image forming apparatus 101, and combines image signals to be displayed. Furthermore, depending on the image signal to be displayed, the CPU 107 sends a control signal to the controller 103 for controlling the image forming apparatus so as to control the image display frequency, the scanning method (for example interlaced or non-interlaced scanning), the number of scanning lines, etc. The CPU 107 also outputs image, character, and graphics data directly to the image generation circuit 108 and inputs image, character, and graphics data from an external computer or storage device via the input/output interface circuit 106.

The CPU 107 may be concerned with other operations as required. For example, the CPU 107 may be directly concerned with the operation of generating and processing information as in a personal computer or a word processor. Furthermore, the CPU 107 may also perform an operation such as a numerical calculation in cooperation with an external device connected via the input/output interface circuit 106 and further via the external computer network.

The input device 115 is used by a user to input an instruction, program, or data. Various types of input devices may be employed. They include a keyboard, mouse, joystick, bar code reader, and speech recognition device.

The decoder 105 decodes various image signals given via various members 108–114 into a three primary color signal or into a luminance signal, I-signal, and Q-signal. It is desirable that decoder 105 include an image memory as represented by a broken-line block in FIG. 20. This allows the decoder 105 to deal with a TV signal such as a MUSE signal which requires an image memory in the decoding operation.

The image memory makes it easy to display a still image, and also makes it possible to easily perform various image processing and editing operations such as image thinning, interpolation, scaling up and down, or combining in cooperation with the image generation circuit 108 and the CPU 107.

The multiplexer 104 selects image data to be displayed in response to the control signal supplied by the CPU 107. That is, the multiplexer 104 selects an desired image signal from the decoded image signals supplied from the decoder 105 and sends the selected image signal to the driving circuit 102. In this selection operation, if image signals are switched periodically during a frame time period, it is possible to display various images in different areas on a screen as in a multi-image TV.

The image display controller 103 controls the operation of the driving circuit 102 according to the control signal supplied from the CPU 107.

The image display controller 103 is concerned with various controlling operations. For example, in the basis controlling operation, the image display controller 103 outputs a control signal to the driving circuit 102 so as to control the sequential operations of a driving power supply (not shown) for driving the image forming apparatus 101. Furthermore, in the operation of controlling the driving mode of the image forming apparatus, the image display controller 103 outputs a control signal designating the displaying frequency and scanning mode (interlaced or noninterlaced) to the driving circuit 102. In some cases, the image display controller 103 outputs a control signal to the driving circuit 102 so as to perform image quality adjustment such as brightness, contrast, and sharpness.

The driving circuit 102 generates a driving signal for driving the image forming apparatus 101. The operation of the driving circuit 102 is performed on the basis of the image signal supplied from the multiplexer 104 and also the control signal supplied from the image display controller 103.

The image display device shown in FIG. 20 has various functional blocks as described above, and has the capability of displaying image information given from various image information sources on the image forming apparatus 101. That is, various image signals such as a television broadcasting signal are decoded by the decoder 105, and a desired image signal is selected via the multiplexer 104 and supplied to the driving circuit 102. In response to the image signal to be displayed, the image display controller 103 generates a control signal for controlling the operation of the driving circuit 102. The driving circuit 102 generates a driving signal on the basis of the above image signal and control signal, and supplies the resultant driving signal to the image forming apparatus 101 so that an image is displayed on the image forming apparatus 101. These operations are generally controlled by the CPU 107.

In the present example of the image display device, the image memory in the decoder 105, the image generation circuit 108, and the CPU 107 all cooperate with each other so that not only one image selected from a plurality of image information is simply displayed but it is also possible to various image processing and editing operations such as scaling up and down, rotation, movement, edge enhancement, thinning, interpolation, color conversion, aspect ratio conversion, combining, deleting, connecting, substituting, and inserting. Furthermore, although no description has been given here, the image display device may also include a dedicated circuit for processing or editing audio information.

According to the present invention, a single image display device can provide various capabilities such as a display of a television broadcasting receiver, a terminal device of for a video conference, an image editing device for processing a still image and/or a motion image, a computer terminal, an office terminal device such as a word processor, and a game machine. Thus, the image display device can be employed in a wide variety of applications in industries and also in home usage.

The image display device shown in FIG. 20 is only an illustrative example, and the image display device may be implemented in various fashion using an image forming apparatus having an electron source provided with surface conduction electron emitting devices.

For example, of the constituent elements of the image display device shown in FIG. 20, undesired elements may be removed. Contrarily, another element may be added as required. For example, when the image display device of the invention is used as a video conference terminal, it is preferable that the image display device further include a TV camera, a microphone, a lighting device, and a transmitting/receiving circuit including a modem.

In the image display device of the invention, the image forming apparatus 101 may be realized in the form of a thin panel, and thus it is possible to realize an image display device having a small size in the depth direction. Furthermore, the image forming apparatus 101 may also be realized in such a manner as to have a large-sized screen which can provide a high brightness and a wide viewing angle and thus can provide a realistic image which can be viewed easily.

Since the image forming apparatus includes the electron source of the invention having stable and excellent electron emitting characteristics, it is possible to realize a color television receiver in the form of a flat panel having the capability of displaying a high-quality color image.

As described above, the present invention provides a surface conduction electron emitting device and an electron source having excellent and stable electron emitting characteristics and also an image forming apparatus capable of displaying a stable high-quality image.

What is claimed is:

1. An electron emitting device including a pair of device electrodes disposed at locations opposite to each other, a conductive thin film in contact with both said pair of device electrodes, and an electron emitting region formed in a part of said conductive thin film, said electron emitting device being characterized in that:

said conductive thin film is composed of fine particles including a first metal element serving as a main constituent element and at least one second metal element which precipitates at a surface of said conductive thin film and thus forms a low work function material layer; and an ionic radius of a most stable ion of said first metal element is greater than an ionic radius of a most stable ion of said at least one second metal element.

2. An electron emitting device according to claim 1, wherein said conductive thin film is composed of fine particles of an alloy including said first metal element and said second metal element.

3. An electron emitting device according to claim 1, wherein said conductive thin film includes fine particles substantially consisting of said first metal element and fine particles substantially consisting of said second metal element.

4. An electron emitting device including a pair of device electrodes disposed at locations opposite to each other, a conductive thin film in contact with both said pair of device electrodes, and an electron emitting region formed in a part of said conductive thin film, said electron emitting device being characterized in that:

said conductive thin film is composed of fine particles having a structure including a phase of a noble metal element, said phase surrounding a phase of an intermetallic compound consisting of said noble metallic element and one of an alkali metallic element and an alkaline-earth metal element.

5. An electron emitting device according to claim 4, wherein said conductive thin film is substantially composed of said noble metal element and said one of the alkali metal element and the alkaline-earth metal element such that said conductive thin film has an average composition with a content of said one of the alkali metal element and the alkaline-earth metal element in a range from 3 atomic % to 8 atomic %.

* * * * *

UNITED STATES PATENT AND TRADEMARK OFFICE

CERTIFICATE OF CORRECTION

PATENT NO. : 5,939,824

DATED : August 17, 1999

INVENTOR(S) : FUMIO KISHI ET. AL

It is certified that error appears in the above-identified patent and that said Letters Patent is hereby corrected as shown below:

ON THE TITLE PAGE [54] Title

Line 4, "DIFFERENCE" should read --DIFFERENT--.

ON THE TITLE PAGE [56] References Cited

FOREIGN PATENT DOCUMENTS,

| | | |
|---|---|---|
| "1031332" | should read | --1-031332--; and |
| 1283749 | | 1-283749 |
| 2257552 | | 2-257552 |
| 7235255 | | 7-235255 |

COLUMN 1

Line 4, "DIFFERENCE" should read --DIFFERENT--.

UNITED STATES PATENT AND TRADEMARK OFFICE

CERTIFICATE OF CORRECTION

PATENT NO. : 5,939,824

DATED : August 17, 1999

INVENTOR(S) : FUMIO KISHI ET. AL

It is certified that error appears in the above-identified patent and that said Letters Patent is hereby corrected as shown below:

COLUMN 7

Line 14, "which" should read --which is--.

COLUMN 8

Line 45, "diffuse" should read --diffuses--.

COLUMN 17

Line 5, "an" should be deleted.

Signed and Sealed this

Twenty-sixth Day of September, 2000

*Attest:*

Q. TODD DICKINSON

*Attesting Officer*

*Director of Patents and Trademarks*